US011198490B2

(12) United States Patent
Liu et al.

(10) Patent No.: US 11,198,490 B2
(45) Date of Patent: Dec. 14, 2021

(54) DISCONNECTABLE SPREAD MOORING AND RISER TOWER SYSTEM AND METHOD

(71) Applicant: Sofec, Inc., Houston, TX (US)

(72) Inventors: Yonghui Liu, Houston, TX (US); Stephen P. Lindblade, Waller, TX (US)

(73) Assignee: SOFEC, INC., Houston, TX (US)

( * ) Notice: Subject to any disclaimer, the term of this patent is extended or adjusted under 35 U.S.C. 154(b) by 71 days.

(21) Appl. No.: 16/527,345

(22) Filed: Jul. 31, 2019

(65) Prior Publication Data

US 2020/0039610 A1 Feb. 6, 2020

Related U.S. Application Data

(60) Provisional application No. 62/712,719, filed on Jul. 31, 2018.

(51) Int. Cl.

| | |
|---|---|
| ***B63B 21/50*** | (2006.01) |
| ***B63B 35/44*** | (2006.01) |
| ***B63B 27/24*** | (2006.01) |

(52) U.S. Cl.

CPC ..... *B63B 21/50* (2013.01); *B63B 27/24* (2013.01); *B63B 35/4413* (2013.01)

(58) Field of Classification Search

CPC ..... B63B 21/50; B63B 21/16; B63B 21/20

See application file for complete search history.

(56) References Cited

U.S. PATENT DOCUMENTS

| | | | | |
|---|---|---|---|---|
| 5,159,891 | A * | 11/1992 | Lohr | B63B 21/20 114/230.2 |
| 5,372,531 | A | 12/1994 | Boatman et al. | |
| 5,937,780 | A | 8/1999 | Etheridge et al. | |
| 6,571,723 | B1 * | 6/2003 | Bech | B63B 21/50 114/230.2 |

(Continued)

FOREIGN PATENT DOCUMENTS

| | | | |
|---|---|---|---|
| EP | 0878389 | 11/1998 | |
| EP | 0878389 A1 * | 11/1998 | B63B 21/50 |

OTHER PUBLICATIONS

International Search Report and Written Opinion for International Application No. PCT/US2019/044326, dated Nov. 13, 2019.

*Primary Examiner* — S. Joseph Morano
*Assistant Examiner* — Jovon E Hayes
(74) *Attorney, Agent, or Firm* — Edmonds & Cmaidalka, P.C.

(57) ABSTRACT

A disconnectable spread mooring and riser tower system for a vessel floating at a water surface. The system comprises a forward chain table assembly releasably connected to the vessel at the bow via a first connector assembly, and an aft chain table assembly releasably connected at the stem via a second connector assembly. Mooring legs are attached to the chain table assemblies and are capable of being anchored at spaced locations on a seafloor. The first and second connector assemblies are arranged and designed to unlock and release the forward and aft chain table assemblies from the vessel. A riser tower system fixed to the seafloor may be located near the moored vessel and flexible jumper hoses can be extended between the riser tower system and the vessel to transfer fluids, air, power and control signals.

24 Claims, 25 Drawing Sheets

(56) References Cited

U.S. PATENT DOCUMENTS

| | | | | |
|---|---|---|---|---|
| 6,851,994 | B2 | 2/2005 | Boatman et al. | |
| 7,007,623 | B2 | 3/2006 | Boatman et al. | |
| 7,347,156 | B2 | 3/2008 | Lindblade | |
| 7,513,208 | B1 | 4/2009 | Seaman et al. | |
| 7,717,762 | B2 | 5/2010 | Boatman et al. | |
| 7,959,480 | B2 | 6/2011 | Lindblade | |
| 8,763,549 | B2 | 7/2014 | Liu et al. | |
| 9,260,949 | B2 * | 2/2016 | Brinkmann | E21B 43/01 |
| 9,340,261 | B2 * | 5/2016 | Macrae | B63B 21/50 |
| 9,616,975 | B2 * | 4/2017 | Meling | B63B 21/50 |
| 9,650,110 | B1 | 5/2017 | Lindblade | |
| 2002/0166698 | A1 * | 11/2002 | Beato | E21B 19/006 175/7 |
| 2003/0206771 | A1 * | 11/2003 | Poldervaart | B63B 21/507 405/210 |
| 2007/0264889 | A1 * | 11/2007 | Boatman | B63B 22/023 441/5 |
| 2014/0216323 | A1 * | 8/2014 | Macrae | B63B 21/50 114/230.21 |
| 2016/0236756 | A1 * | 8/2016 | Haak | B63B 35/44 |
| 2019/0233058 | A1 * | 8/2019 | Lane | B63B 21/00 |

* cited by examiner

DISCONNECTABLE SPREAD MOORING AND RISER TOWER SYSTEM AND METHOD

CROSS-REFERENCE TO RELATED APPLICATIONS

This application claims the benefit of U.S. Provisional Application Ser. No. 62/712,719 filed on Jul. 31, 2018, entitled "Disconnectable Spread Mooring and Riser Tower System and Method." Applicants incorporate by reference herein Application Ser. No. 62/712,719 in its entirety.

BACKGROUND OF THE INVENTION

1. Field of the Invention

The present invention relates generally to disconnectable mooring systems for floating vessels, and more particularly to disconnectable spread mooring systems and riser tower systems for vessels moored on location to load fluids, such as hydrocarbons, from subsea pipelines and risers.

2. Description of the Related Art

This invention relates to disconnectable mooring systems to moor floating vessels to load or unload one or more products from the moored vessels. Typically, the floating vessels are tankers, and particularly floating storage offloading ("FSO") vessels, and floating production, storage and offloading ("FPSO") vessels.

Various types of mooring systems to secure a floating vessel on location in a body of water are known in the art. A representative disconnectable turret mooring system, illustrated in FIGS. 1A and 1B, includes two basic parts—a geostationary buoy that is detachably connectable to a turret assembly of a floating vessel. The floating vessel carries the turret assembly which is rotatably disposed within the vessel hull and which opens to the sea near the elevation of the keel of the vessel. The geostationary buoy is moored to the seafloor by a number of anchor legs. The turret assembly includes a hydraulically-actuated mechanical connector designed and arranged to disconnectably mate with a connector element or hub located on the geostationary buoy.

The disconnectable turret mooring arrangement provides a fluid flow path between a subsea well, pipeline or component and the floating vessel when the vessel is moored to the geostationary buoy. A fluid transfer system ("FTS") includes a flexible conductor or riser, as shown in FIG. 1B, spanning the distance between the seafloor and the geostationary buoy. Other piping and a fluid swivel on the vessel is used to complete the connection between the riser and the system on the vessel. In this turret mooring system, the floating vessel is allowed to freely weathervane about the geostationary turret in response to wind, waves and currents. When the geostationary buoy is completely separated from the floating vessel, the buoy is designed and arranged to sink to a neutrally buoyant position, typically about 36 meters below sea level, and the vessel can leave the location.

Typically, the floating vessel moors to the geostationary buoy by first recovering the submerged buoy upwards to the structural connector of the turret assembly using a retrieval line with a winch system. The structural connector is then locked into engagement with the connector hub which moors the floating vessel to the seafloor.

A representative disconnectable tower yoke mooring system with jumpers for a shallow water application is illustrated in FIG. 2. The tower yoke mooring system includes a jacket structure fixed to the seafloor. One or more decks are mounted on the jacket structure in addition to a turntable. A yoke has one end releasably connected to a yoke head pivotably attached to the turntable and a second end connecting with a mooring support structure mounted on the floating vessel. The yoke and yoke head each have a mating connector portion arranged and designed to connect the yoke to the yoke head. When the connector portions are engaged and locked, the yoke is securely attached to the yoke head, allowing a rigid interconnection between the floating vessel and tower structure. When the yoke is connected to the yoke head, the floating vessel is allowed to weathervane about the jacket structure. Riser piping extends from the seafloor to the jacket deck and connects to fluid jumpers or hoses which span between the jacket deck and the floating vessel. Electrical jumpers may also span between the jacket deck and the vessel. In the event of predicted abnormally high sea states, the yoke may be disconnected from the yoke head and secured to the floating vessel and the vessel removed prior to the abnormally high sea state event. Assignee's U.S. Pat. No. 9,650,110 discloses a disconnectable tower yoke mooring system.

A representative spread mooring system, shown in FIG. 3, includes a plurality of anchor legs extending from the bow and stern of the floating vessel to the seafloor. The anchor legs are typically chain or wire, or a combination of chain and wire. An anchor is typically attached to the seafloor-end of the anchor leg and the vessel-end of the anchor leg is arranged and designed to be connected to a chain stopper assembly on the vessel. The spread mooring system is commonly utilized in an area with directional environments. In the conventional spread mooring system, the anchor legs must be retrieved onto the floating vessel or released to the seafloor in order for the vessel to move off location.

Hurricane or typhoon or cyclone waves can present significant risks and challenges to spread mooring systems, particularly in shallow water. Retrieval of the anchor legs requires substantial time and effort, in addition to substantial time and effort in placing the anchor legs when moving back on location after the inclement weather has passed.

It is desirable to have a mooring system that can be disconnected and reconnected efficiently. It is further desirable to have a mooring system that can be disconnectable in high sea states.

SUMMARY OF THE INVENTION

An embodiment of the present invention relates generally to a disconnectable spread mooring system and a riser tower system to be implemented for abnormally high sea areas, such as hurricane/typhoon/cyclone wave areas, particularly in shallow water. The embodiments of the present invention comprise disconnectable mooring systems to moor and unmoor floating vessels in situ, usually tankers, and particularly FSO vessels and FPSO vessels. A riser tower positioned near the moored vessel allows one or more flexible jumper hoses and/or umbilicals to be utilized between the riser tower and the vessel with connectors to transfer fluids, air, power, control signals, etc.

Chain table assemblies, with or without buoyancy compartments, can be mounted at bow and stern areas of the vessel by a vertical mechanical connector either above the waterline, partially submerged or fully submerged in water with the spread mooring legs attached, or connected at an angle from vertical. The chain table assemblies may be disconnected from, and reconnected to, the bow and stern areas via the mechanical connector. After disconnection, the chain table assemblies will be lowered in the water either floating with the buoyancy compartments or sitting above the mudline with a mudmat/suction plate or legs. The chain table assemblies with mooring legs can be pulled from the water or from the seafloor and reconnected to the bow and stern connectors after the storm. In an alternate embodiment, floating chain table assemblies with buoyancy compartments will be secured either by connecting tie-back hawsers together or connecting the hawsers to one or more fixed structures, or even rest on the seafloor with the buoyancy compartments flooded after disconnection.

Before mooring chain table assembly disconnection and reconnection operations, all the jumpers and cables between the riser tower and the moored vessel need be disconnected and stored either on the vessel or on the riser tower.

One or more products, particularly liquid petroleum oil and gas products, water, air, electricity, control signals, etc., can be transferred between the moored vessels and shuttle tankers by means of tandem or alongside loading/offloading or catenary anchor leg mooring ("CALM")/single anchor leg mooring ("SALM") buoy loading/offloading, or between the moored vessels and other facilities through the riser tower systems.

BRIEF DESCRIPTION OF THE SEVERAL VIEWS OF THE DRAWINGS

The invention is better understood by reading the detailed description of embodiments which follows and by examining the accompanying drawings, in which.

DESCRIPTION OF THE PREFERRED EMBODIMENTS

Figure 1A:
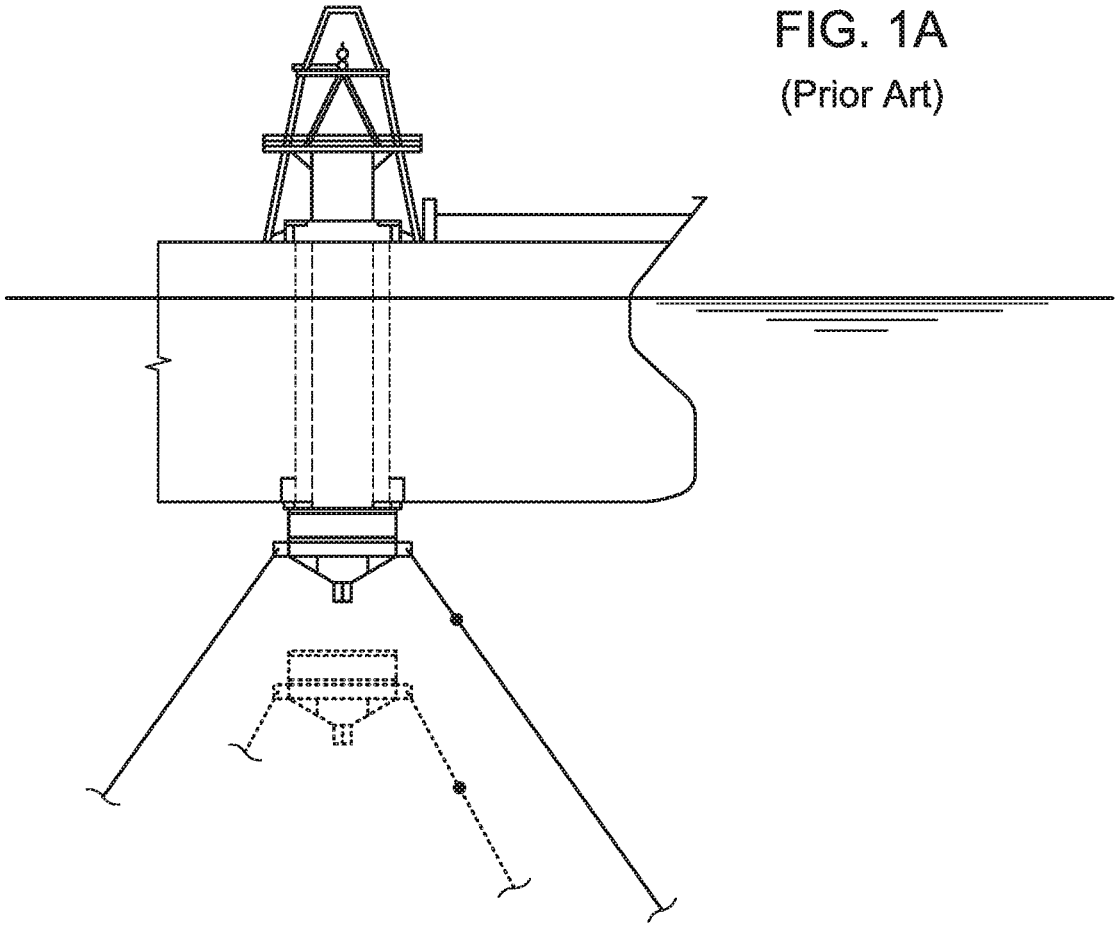
FIG. 1A (Prior Art)
FIGS. 1A and 1B are a side elevation view and plan view respectively of a prior art disconnectable turret mooring system.
Figure 1B:
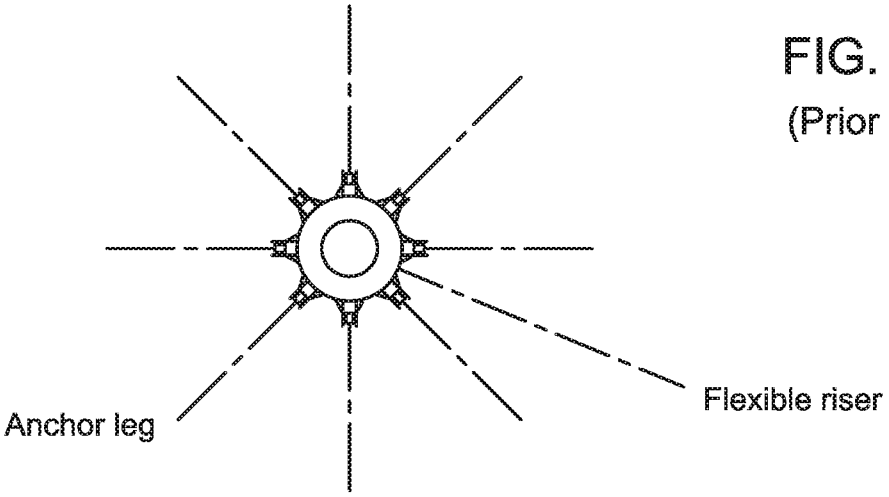
FIG. 1B (Prior Art)
Figure 2:
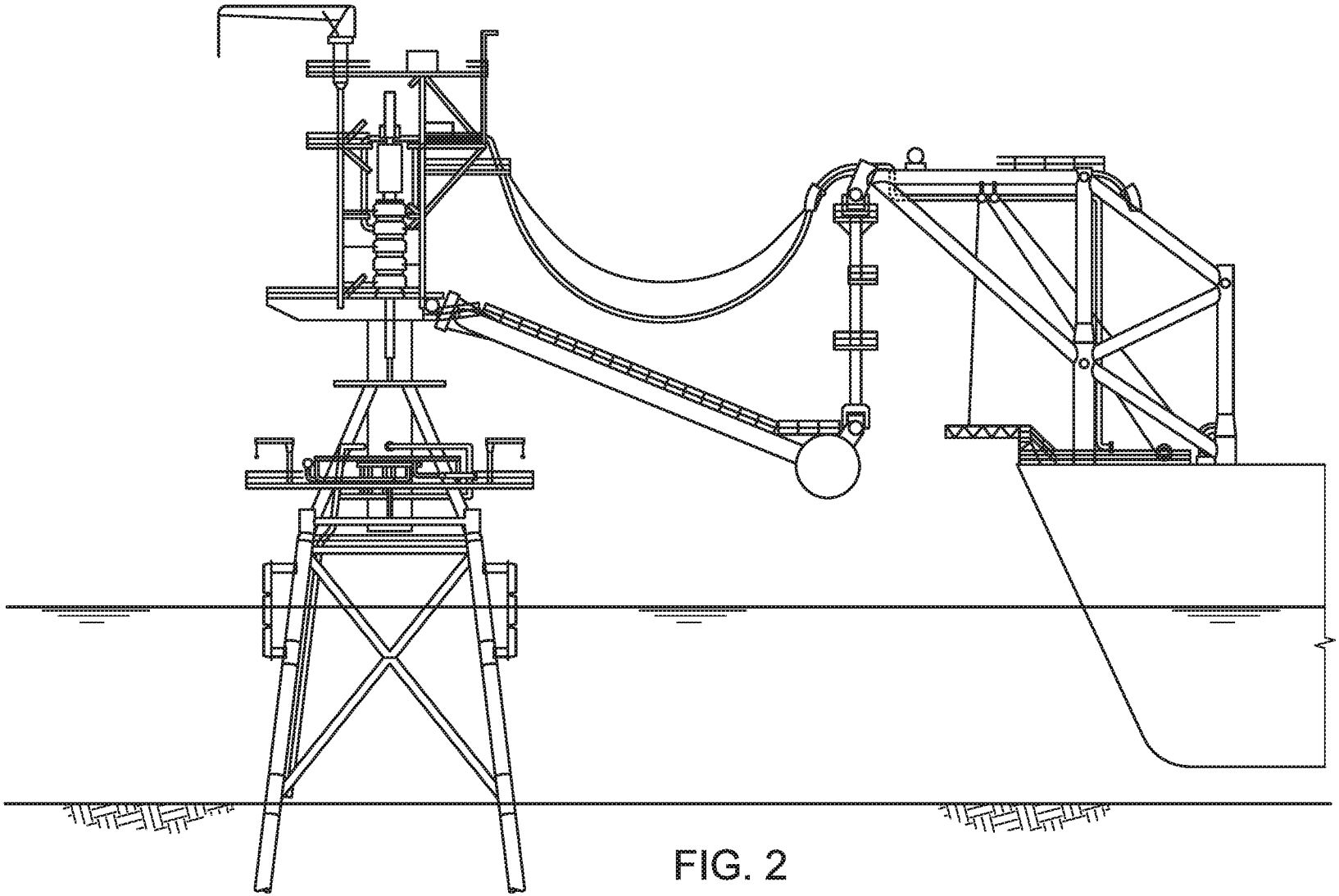
FIG. 2 (Prior Art)
FIG. 2 is a side elevation view of a prior art disconnectable tower yoke mooring system.
Figure 3:
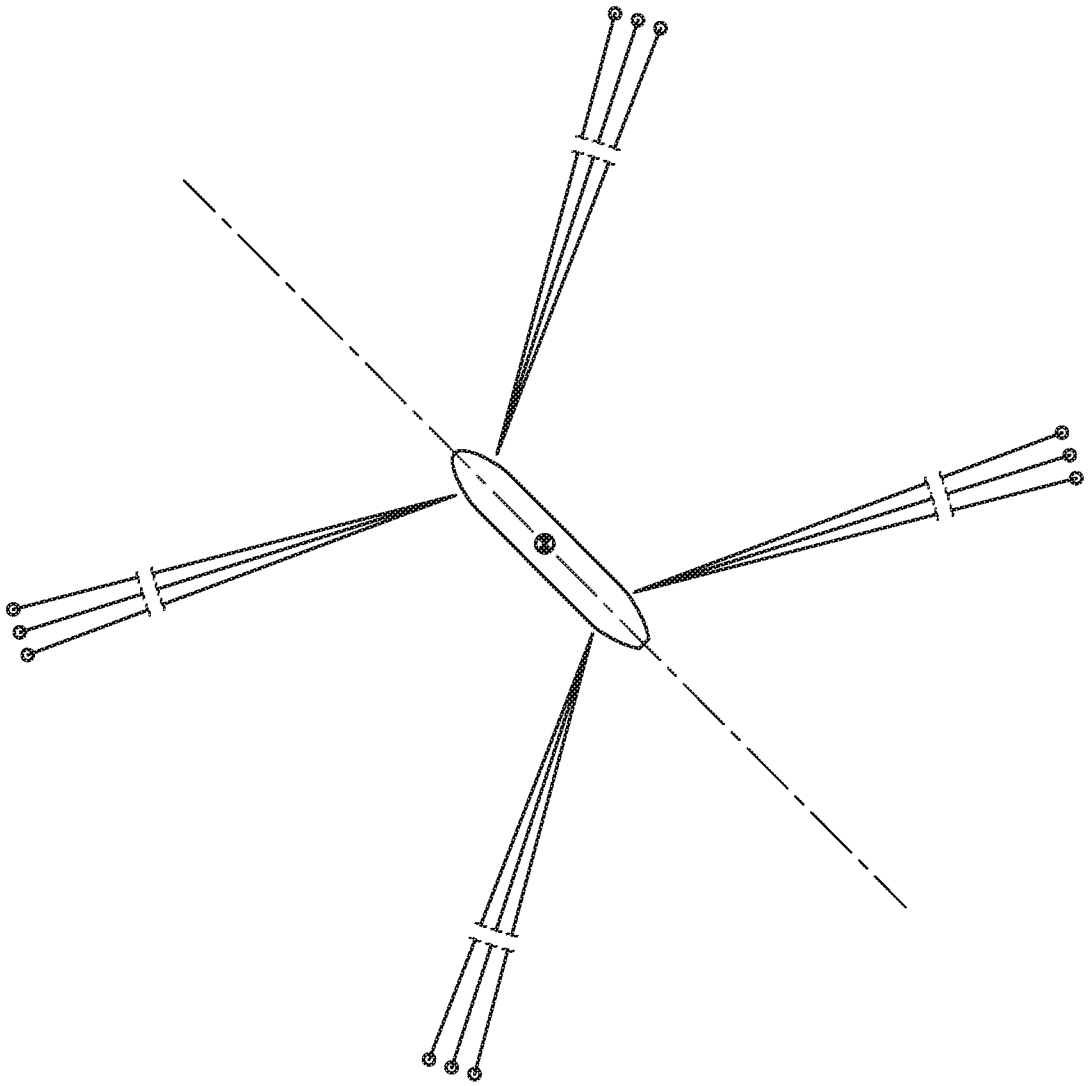
FIG. 3 (Prior Art)
FIG. 3 is a plan view of a prior art spread mooring system.
Figure 4A:
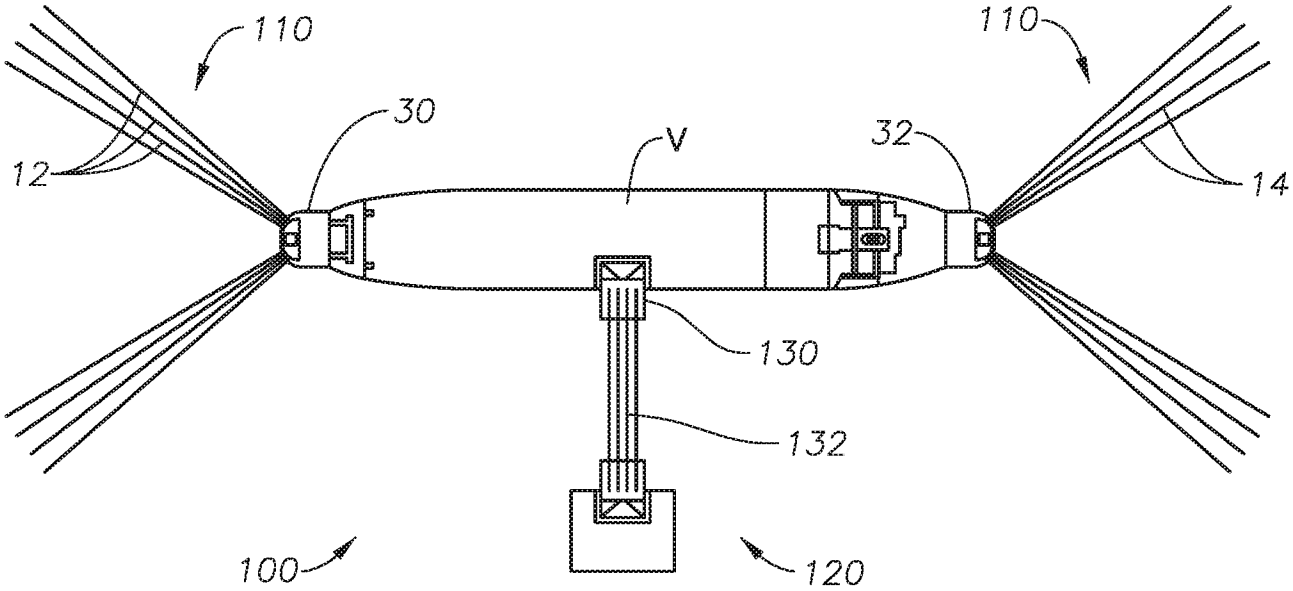
FIG. 4A is a plan view of a disconnectable spread mooring and riser tower system according to a preferred embodiment of the present invention.
Figure 4B:
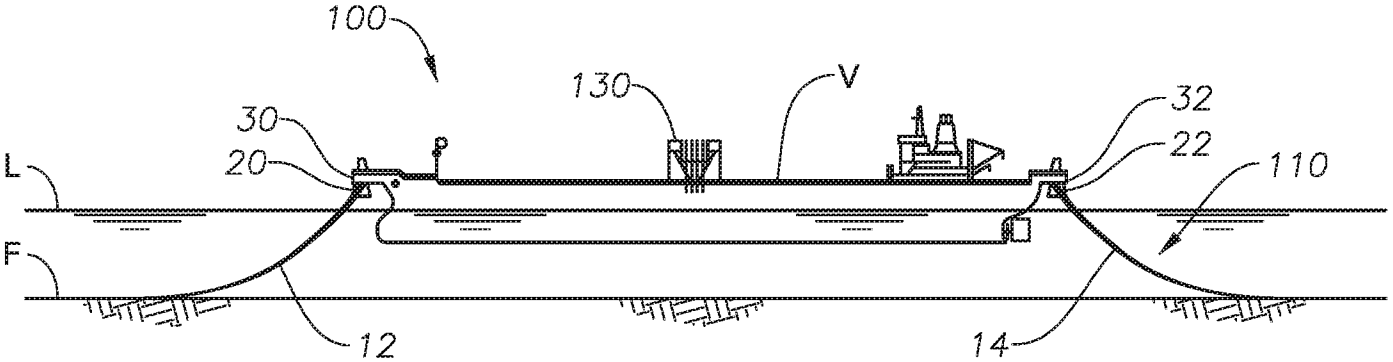
FIG. 4B is a side elevation view of the disconnectable spread mooring and riser tower system shown in FIG. 4A.
Figure 4C:
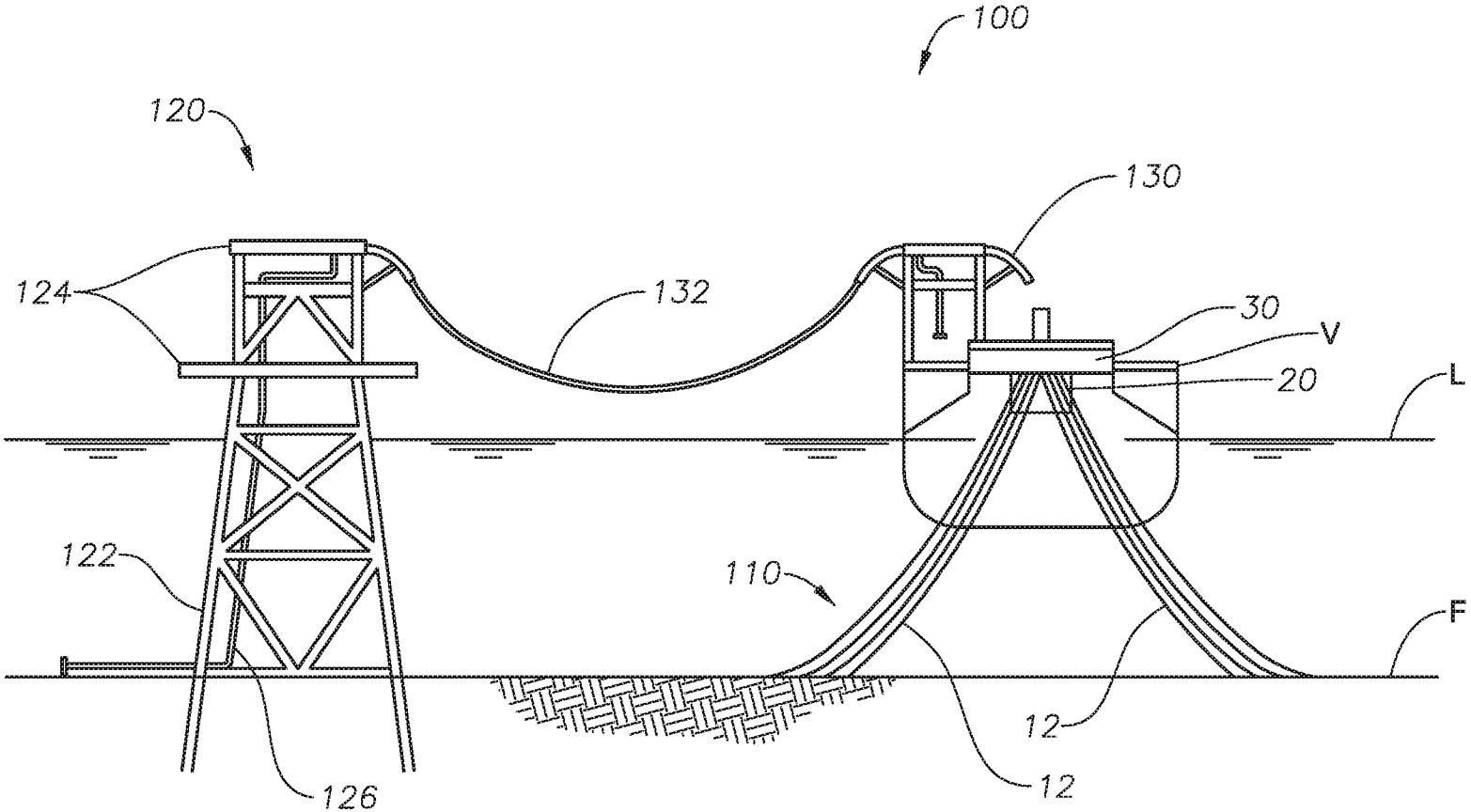
FIG. 4C is a front elevation view of the disconnectable spread mooring and riser tower system shown in FIG. 4A.

The preferred embodiments of the present invention will now be discussed with reference to the drawings. The preferred embodiments are a disconnectable spread mooring and riser tower system for a floating vessel V for abnormally high sea areas, such as hurricane/typhoon/cyclone wave applications, particularly in shallow water. FIGS. 4A, 4B and 4C show a preferred embodiment of the disconnectable spread mooring and riser tower system, referred to generally as 100, mooring a vessel V. The disconnectable spread mooring and riser tower system 100 includes a disconnectable spread mooring system 110 and a riser tower system 120.

The disconnectable spread mooring system 110 comprises a plurality of mooring or anchor legs 12 extending from the bow of the vessel V to the seafloor F and a plurality of mooring or anchor legs 14 extending from the stern of the vessel V to the seafloor F. The anchor legs 12, 14 may include lengths of chain or wire or combinations of chain and wire, and include an anchor.

FIG. 4A shows a quantity of eight bow anchor legs 12 and eight stern anchor legs 14, however, different numbers of anchor legs may be used. As shown in FIG. 4A, four of the bow anchor legs 12 are placed forward of the vessel V to the starboard side (right side looking forward) and four of the bow anchor legs 12 are placed forward of the vessel V to the port side (left side looking forward). Similarly, four of the stern anchor legs 14 are placed rearward of the vessel V to the starboard side and four of the stem anchor legs 14 are placed rearward of the vessel V to the port side. Preferably, the lengths of anchor legs 12, 14 are initially placed using tug boats or work boats. It is to be understood that the placement, orientation, quantity and length of the anchor legs 12, 14 are dependent on numerous factors which are not limiting of the scope of the claimed invention.

Referring to FIG. 4B, one end of each of the bow anchor legs 12 is connected to a forward disconnectable chain table assembly 20 and one end of each of the stem anchor legs 14 is connected to an aft disconnectable chain table assembly 22. The disconnectable chain table assemblies 20, 22 are similar to one another and may be identical.

Referring to FIG. 4C, the riser tower system 120 comprises a jacket structure 122, or a tower, affixed to the seafloor F, typically via piling. The riser tower system 120 includes a plurality of decks 124 mounted on the jacket structure 122 at various elevations above the water level L, typically mean water level. It is to be understood by those of skill in the art that the decks 124 are arranged and designed to support various equipment, for example, a manifold, piping, hoses, J-boxes and jumper pull-in equipment. One or more risers 126 connect with subsea piping, a subsea well or other subsea component and are attached to the jacket structure 122. The risers 126 may be connected to a manifold or other equipment on the decks 124.

In the embodiment shown in FIGS. 4A, 4B and 4C, a jumper support structure 130 is installed on the deck of the vessel V adjacent one side (port or starboard). In FIG. 4B, the jumper support structure 130 is located along a midsection of the vessel V. It is to be understood that the location of the jumper support structure 130 may be located elsewhere on the vessel V. For example, it can be located at the bow area (or stern area) of the vessel V as shown in the alternative arrangement of FIGS. 12A and 12B.

As shown in FIG. 4C, the jumper support structure 130 preferably includes one or more decks arranged and designed to support piping. J-boxes, and jumper pull-in equipment. During normal operation with the vessel V moored near the riser tower system 120 via the connected chain table assemblies 20, 22 and anchor legs 12, 14, one or more flexible jumper hoses and/or umbilicals 132 are utilized between at least one riser tower deck 124 and the vessel jumper support structure 130 with connectors to transfer fluids, air, power and control signals, etc.

Figure 5A:
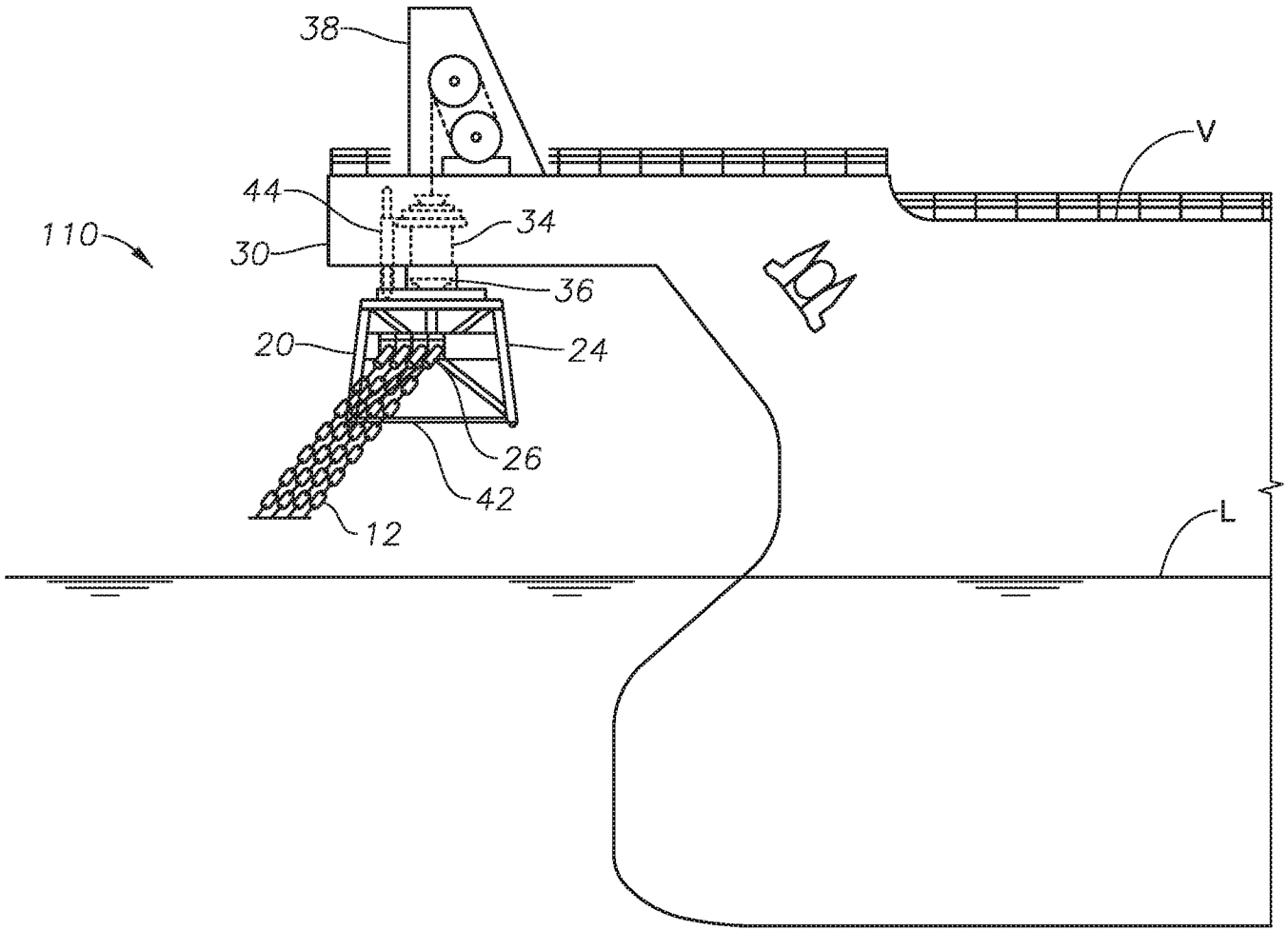
FIG. 5A is a partial side elevation view showing a forward chain table assembly connected to a forward connector assembly above the waterline.
Figure 6:
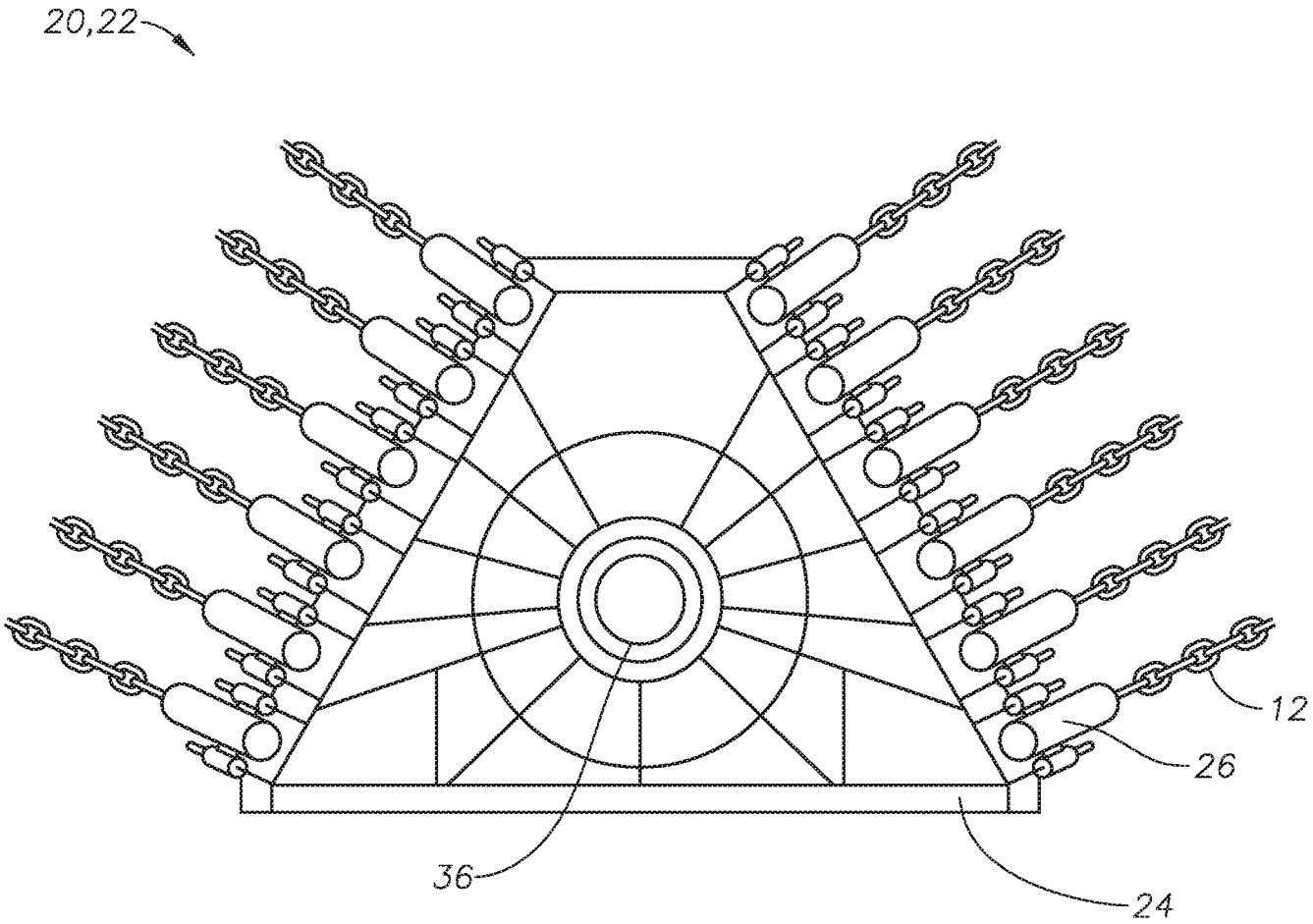
FIG. 6 is a plan view of a preferred disconnectable chain table assembly arrangement with connector hub and chain stoppers.

FIG. 5A illustrates the portion of the disconnectable spread mooring system 110 at the bow of the vessel V in a preferred embodiment. It is to be understood that the following description is also applicable to the portion of the disconnectable spread mooring system 110 at the stern. Each disconnectable chain table assembly 20, 22 includes a chain table structure 24 preferably having a chain stopper 26 to which one end of the anchor legs 12, 14 is attached. The chain table structure 24 may be a generally box-shape or cylindrical shape with plates, stiffeners or frame with bracing. FIG. 6 is a plan view of a chain table structure 24 with a plurality of chain stoppers 26 and connected anchor legs 12 and an upper connector hub 36. In certain chain table assembly embodiments, at least a portion of the cross-sectional area of the bottom of the chain table assembly 20, 22 includes a plate member or mudmat 42 (FIG. 5A) for resting on the seafloor F for purposes of stability as will be discussed below. The chain table assembly may alternatively or additionally have one or more buoyancy compartments as discussed below in conjunction with other embodiments of the invention.

With reference to FIGS. 4A-4C and 5A, the floating vessel V preferably includes a forward chain table support structure 30 extending forward of the vessel hull and an aft chain table support structure 32 extending rearward of the vessel hull. As shown in FIG. 5A, each chain table support structure 30, 32 includes a connector assembly 34, preferably hydraulically-powered, arranged and designed to engage the connector device or hub 36 of the disconnectable chain table assemblies 20, 22. Such connector assemblies 34 are well known in the art. Preferably, the connector hub 36 is located at or near the upper end of the disconnectable chain table assembly 20, 22.

Figure 7:
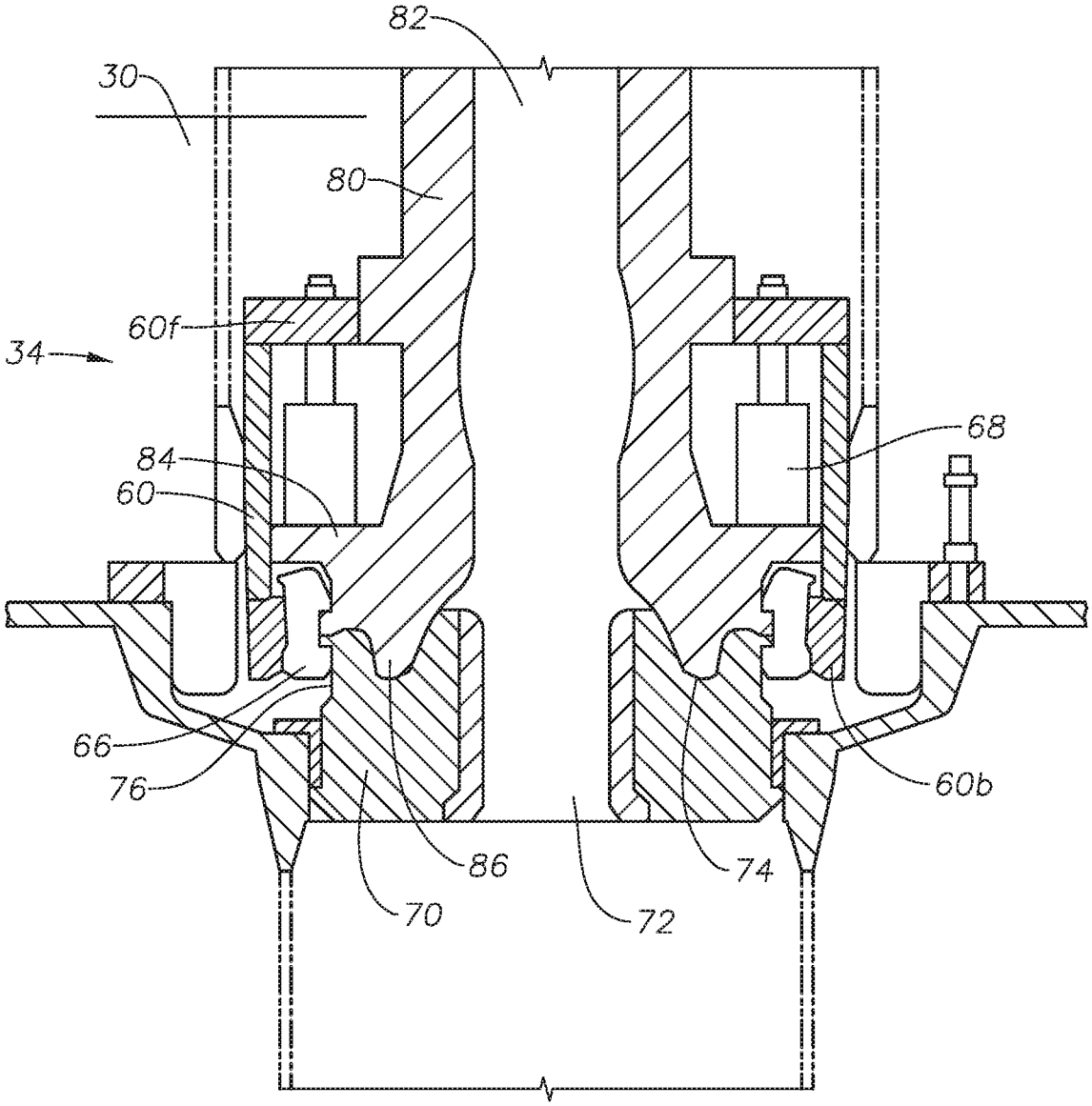
FIG. 7 is a representative hydraulically-actuated mechanical connector assembly shown in a partial cross-sectional view.

A representative connector assembly 34 is shown latched or engaged in FIG. 7. The representative connector assembly 34 shown is a hydraulically-actuated collet connector assembly. The connector assembly 34 is positioned inside of the chain table support structure 30. The hydraulic connector assembly 34 has a stationary housing 80 mounted within the chain table support structure 30. The stationary housing 80 is preferably a substantially cylindrical housing having a bore 82 therethrough. The stationary housing 80 includes an outwardly facing shoulder 84 and an extension or projection 86. One or more spaced apart fingers or collet segments 66 can be disposed about the housing 80 between the shoulder 84 and the projection 86. The outwardly facing shoulder 84 can be adjacent to and in contact with the fingers 66.

The hydraulic connector assembly 34 may include a movable sleeve 60 disposed about the housing 80. The movable sleeve 60 can have an inwardly directed flange **60*f* at one end and a band 60*b* at an opposite end. The band 60*b* can be adjacent to and configured to contact the one or more fingers 66. Linear movement of the sleeve 60 in a first direction (downward) allows the fingers 66 to rotate or pivot to a closed or locked position as shown in FIG. 7 and linear movement of the sleeve 60 in an opposite, second direction (upward) allows the fingers 66 to rotate or pivot about the outer surface of the housing 80** to an open or unlocked position.

One or more actuators 68 may be used to move the sleeve 60 about the outer surface of the housing 80, allowing the fingers 66 to rotate or pivot open and close. The one or more actuators 68 can be positioned between and connected to the inwardly directed flange **60*f* of the movable sleeve 60 and the outwardly facing shoulder 84 of the stationary housing 80. The actuator(s) 68 can be hydraulic or pneumatic and are preferably hydraulic cylinders. When more than one actuator 68 is used, the actuators 68 are controlled by a singular control to provide simultaneous operation and movement of the sleeve 60. The actuators 68** can be actuated from the vessel V by accumulators and telemetry-controlled valves. Accumulators and telemetry-controlled valves are well known to those skilled in the art.

Still referring to FIG. 7, a mating hub 70 of the hydraulic connector assembly 34 is mounted to the chain table assembly 20. Preferably, the mating hub 70 is an annular member having a bore 72 extending therethough. The mating hub 70 may include a recessed section or receptacle 74 sized and shaped to receive the projection 86 on the assembly housing 80. The mating hub 70 may also include a notched or profiled outer surface 76. The profiled outer surface 76 is configured to engage and hold a similarly contoured profile disposed on the fingers 66 such that when the fingers 66 rotate or pivot to their locked or closed position, the shaped profiles located on the fingers 66 and the profiled outer surface 76 of the mating hub 70 matingly engage one other, as depicted in FIG. 7.

FIG. 7 shows the hydraulic connector assembly 34 engaged with the mating hub 70. The actuators 68 have moved the moveable sleeve 60 in the downward direction, with the band 60*b* pushing the fingers 66 to rotate or pivot inwardly (toward the outer surface of the housing 80), such that the fingers 66 engage the recessed profile 76 of the mating hub 70. In this closed position, the fingers 66 are generally parallel to the bore 82 of the housing 80 and overlap the profiled outer surface on the mating hub 70, forming a lock and key engagement therebetween. Also in this closed position, the projection 86 on the housing 80 can be located within the receptacle 74 of the mating hub 70. With the fingers 66 forcibly inserted in the mating hub recess 76, the chain table assembly 20, 22 is securely connected to the chain table support structure 30, 32. Preferably, secondary mechanical locks (not shown) in line with the actuators 68 keep the connector locked without the need of hydraulic pressure. Secondary mechanical locks may be interference sleeve locks such as the Bear-Loc™ locking device, manufactured by Wellman Dynamics Machining and Assembly Inc. of York, Pa.

Preferably, each chain table support structure 30, 32 includes a pull-in or winch assembly 38 (FIG. 5A), such as a traction winch assembly, for lowering and retrieving the disconnectable chain table assembly 20, 22, as will be described below. It is to be understood that the pull-in assembly is intended to include any combination of winches, hydraulic cylinder, chain jack, strand jack or other pulling mechanism well known to those of skill in the art.

In the preferred embodiment, an alignment pin assembly 44 is provided to maintain the proper alignment of the disconnectable chain table assemblies 20, 22 with the vessel V, as shown in FIG. 5A. The alignment pin assembly 44 prevents rotation of the disconnectable chain table assemblies 20, 22 relative to the floating vessel V when the disconnectable chain table assemblies 20, 22 are connected to the connector assembly 34. It is to be understood that the alignment pin assembly 44 can take many forms well known in the art. For example, the alignment pin assembly 44 could be a pin extending downwardly from the chain table support structure 30, 32 which is arranged and designed to be received in a receiver at the upper end of the disconnectable chain table assembly 20, 22.

Figure 9:
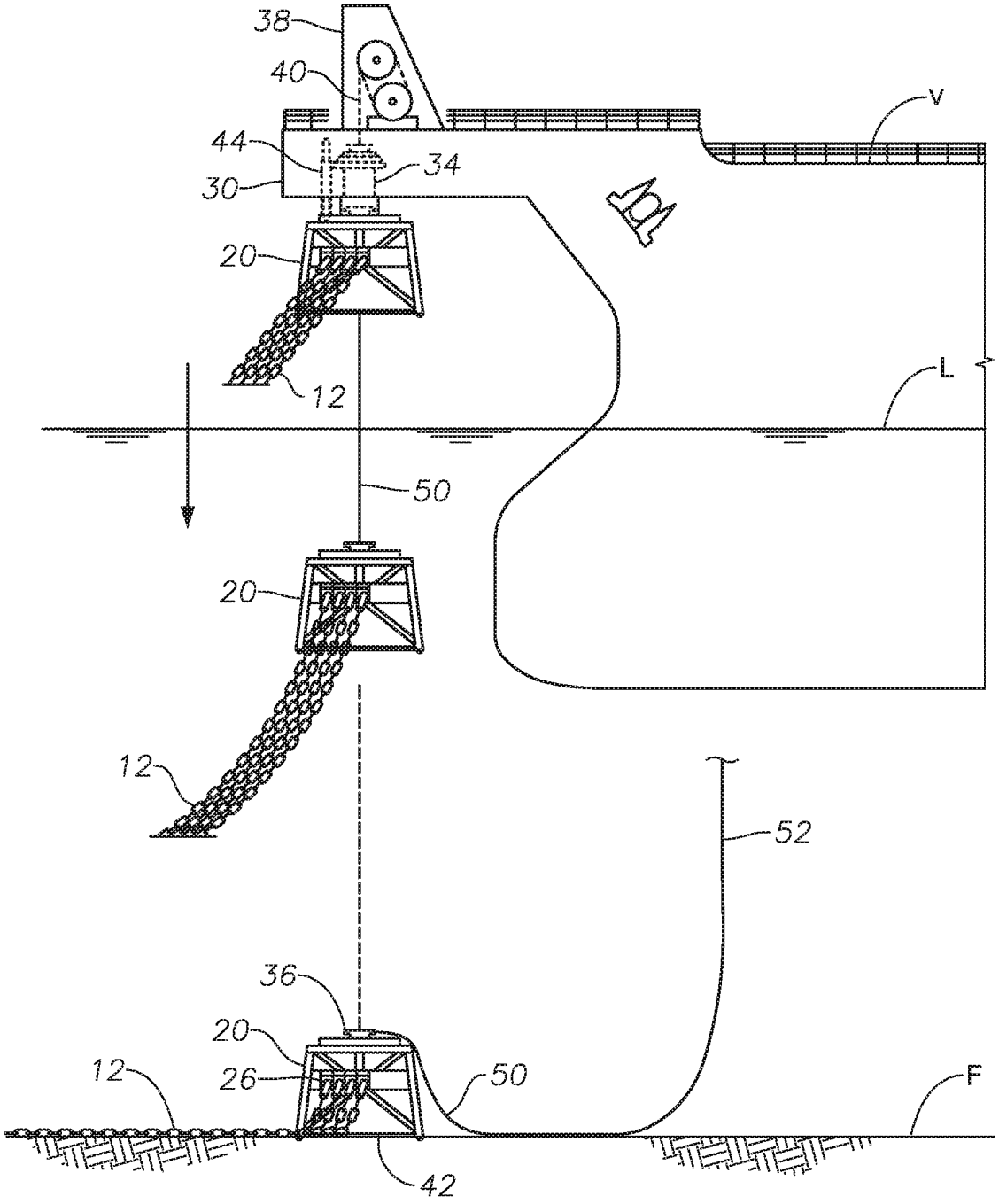
FIG. 9 is view similar to FIG. 6A, showing a chain table assembly being lowered from the vessel to the seafloor during the disconnection sequence.

As stated above, the present invention provides a mooring system that can be disconnected efficiently and in high sea states. This is accomplished, in part, in certain embodiments of the present invention by disconnecting and lowering the forward and aft disconnectable chain table assemblies 20 and 22 to the seafloor F. FIG. 9 illustrates a sequence of steps in disconnecting and lowering the forward disconnectable chain table assembly 20 to the seafloor F. It is to be understood that the same sequence of steps applies to disconnecting and lowering the aft disconnectable chain table assembly 22.

A retrieval rope 50 has one end connected to the forward disconnectable chain table assembly 20, and a second end connected to the winch line 40 of the winch assembly 38. Preferably, a tag line with a surface buoy 52 is also attached to the retrieval line 50. The connector assembly 34 is activated to its unlocked position and the load of the forward disconnectable chain table assembly 20 with the connected bow mooring legs 12 is transferred to the winch assembly 38. The winch assembly 38 then lowers the disconnected chain table assembly 20 until bow mooring legs 12 and the disconnectable chain table assembly 20 come to rest on the seafloor F. The winch line 40 is disconnected from the retrieval rope 50 and returned to the vessel. The mudmat 42 at the bottom of the disconnectable chain table assembly 20 rests on the seafloor F and creates a suction with the seafloor F providing stability. Preferably, the chain stoppers 26 and connector hub 36 are located above the mudline as shown in FIG. 9.

Figure 8:
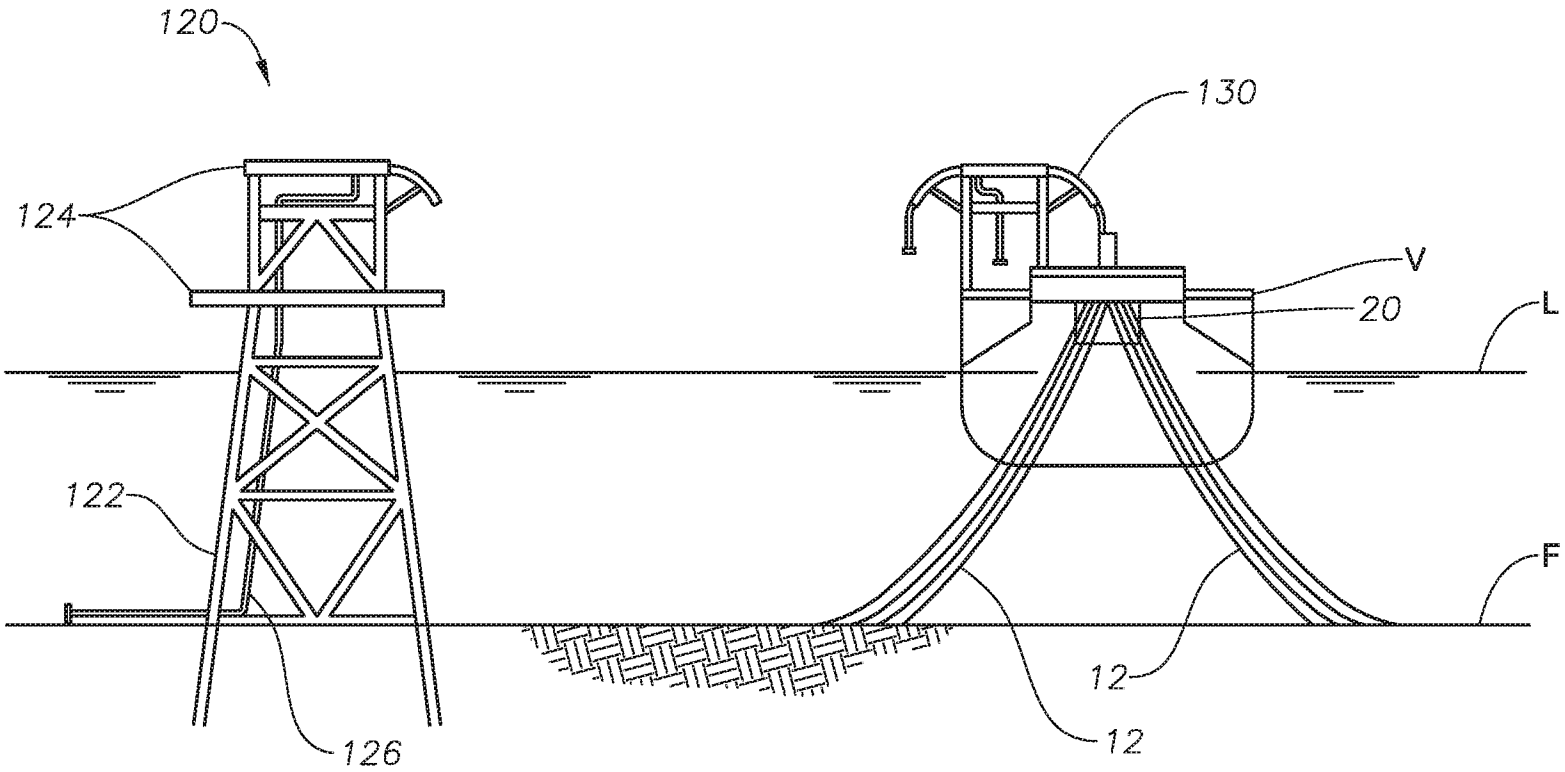
FIG. 8 is a view similar to FIG. 4C showing a jumper disconnection and reconnection between the vessel and the riser tower.

The sequence of steps involved in moving the moored vessel V off location from the spread mooring and riser tower system arrangement 100, as shown in FIGS. 4A-4C, will now be described. Initially and before mooring leg disconnection, all the jumper hoses and cables 132 spanning between the riser tower decks 124 and the jumper support structure 130 of the vessel V (see FIGS. 4A and 4C) are disconnected and pulled onto the vessel V or onto the riser tower 120 as shown in FIG. 8.

Figure 10:
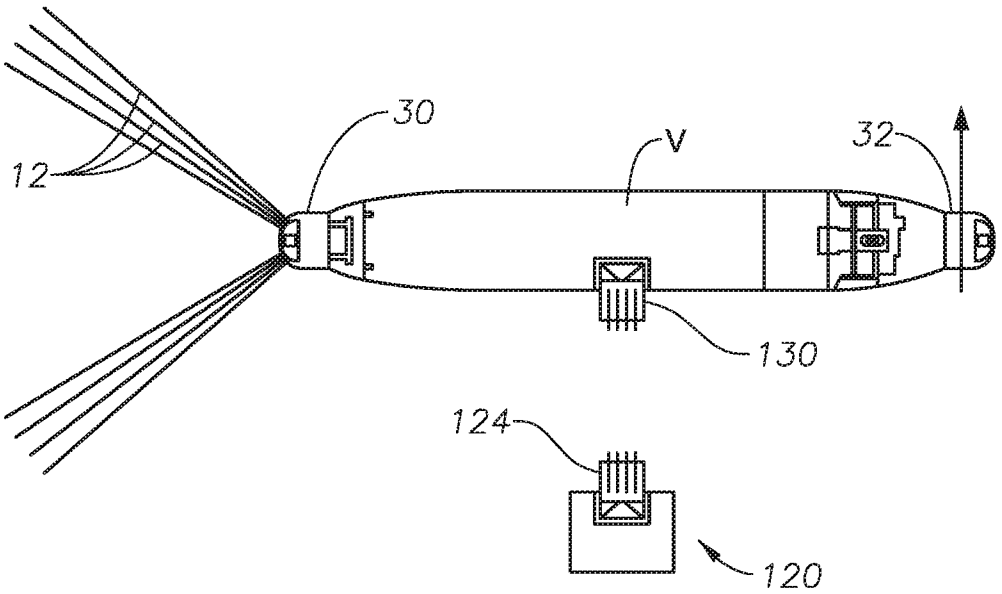
FIG. 10 is a view similar to FIG. 4A showing thrusters being used to swing the vessel away from the riser tower during disconnection.

Preferably, the aft disconnectable chain table assembly 22 with stern mooring legs 14 is disconnected first during the mooring leg disconnection. Upon lowering and resting the aft disconnectable chain table assembly 22 on the seafloor F as described above with respect to FIG. 9, the vessel V swings away from the riser tower 120 a safe distance, preferably via its thruster at the stern, as shown in FIG. 10. The forward disconnectable chain table assembly 20 with bow mooring legs 12 is then disconnected from the vessel V as described above. After all the disconnections, the vessel V can sail away to a safe harbor leaving behind the disconnectable spread mooring system 110 and the riser tower system 120. It is to be understood that alternatively the forward disconnectable chain table assembly 20 with bow mooring legs 12 may be disconnected first, in which case the vessel V would then swing away from the riser tower 120 a safe distance, preferably via a thruster at the bow, and lastly the aft disconnectable chain table assembly 22 with stern mooring legs would be disconnected.

Figure 11:
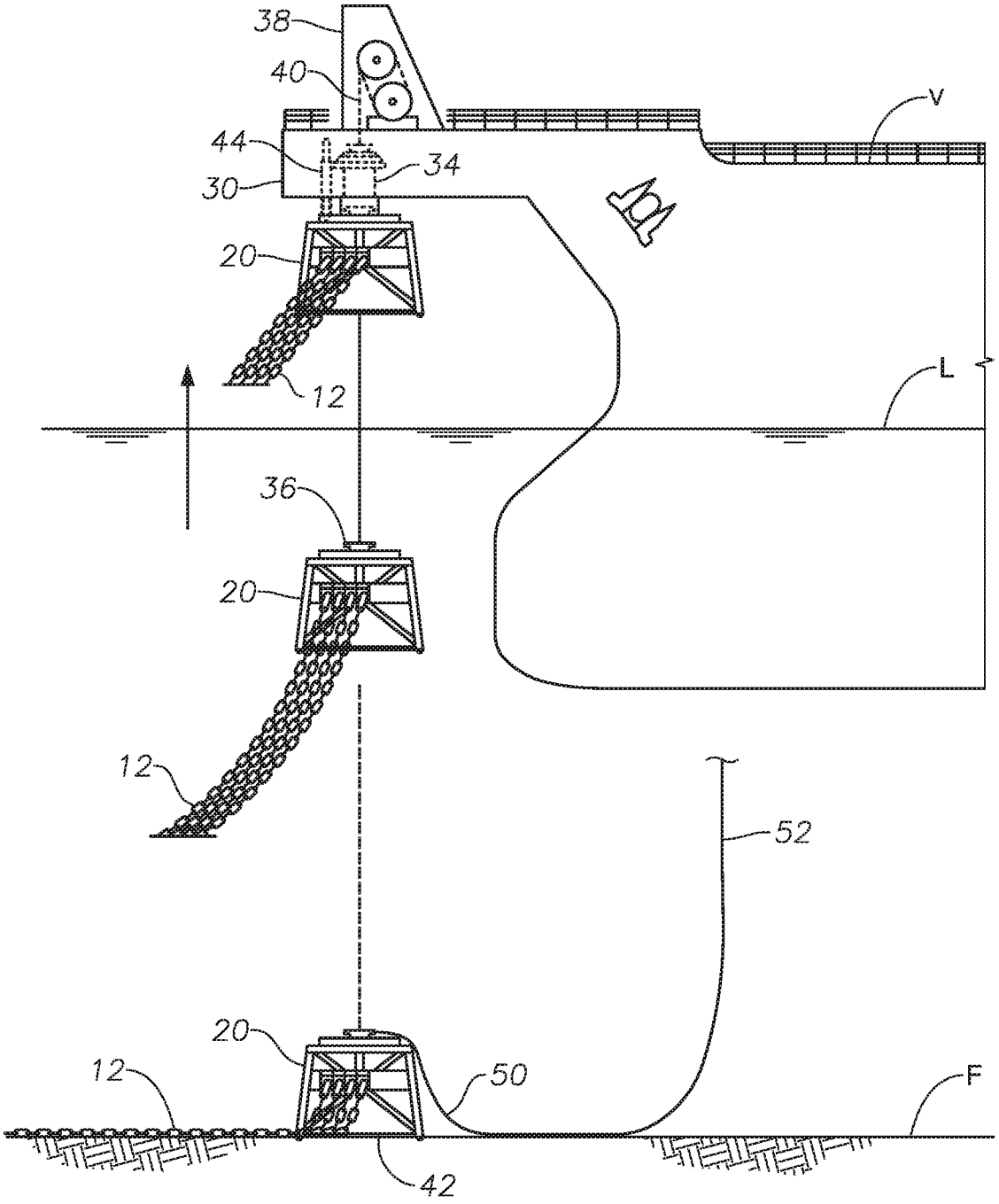
FIG. 11 is a view similar to FIG. 9, showing the chain table assembly being raised from the seafloor to the vessel during the reconnection sequence.

The present invention also provides for efficiently reconnecting the disconnectable spread mooring system 110 upon the vessel V returning to the location. FIG. 11 shows a sequence of steps in retrieving the forward disconnectable chain table assembly 20 from the seafloor F and reconnecting it to the vessel V. It is to be understood that the same sequence of steps applies to retrieving and reconnecting the aft disconnectable chain table assembly 22.

The surface buoy and tag line 52 are used to locate the forward disconnectable chain table assembly 20 located on the seafloor F and the winch line 40 is connected to the retrieval rope 50, which is connected to the forward disconnectable chain table assembly 20. Preferably, the tag line with the surface buoy 52 is retrieved to the vessel V. The winch assembly 38 draws in the winch line 40 and raises the disconnectable chain table assembly 20 along with the connected ends of the bow anchor legs 12 off the seafloor F. With the connector assembly 34 in its unlocked position, the alignment pin 44 stabs into the receiver and the connector hub 36 is received in the connector assembly 34. The connector assembly 34 is then locked to retain the connector hub 36 and the forward disconnectable chain table assembly 20 is reconnected to the vessel V.

After reconnecting the forward and aft disconnectable chain table assemblies 20 and 22 to the vessel V, the flexible jumper hoses and/or umbilicals 132 between the riser tower 120 and the vessel V can be connected to resume normal operations.

Figure 12A:
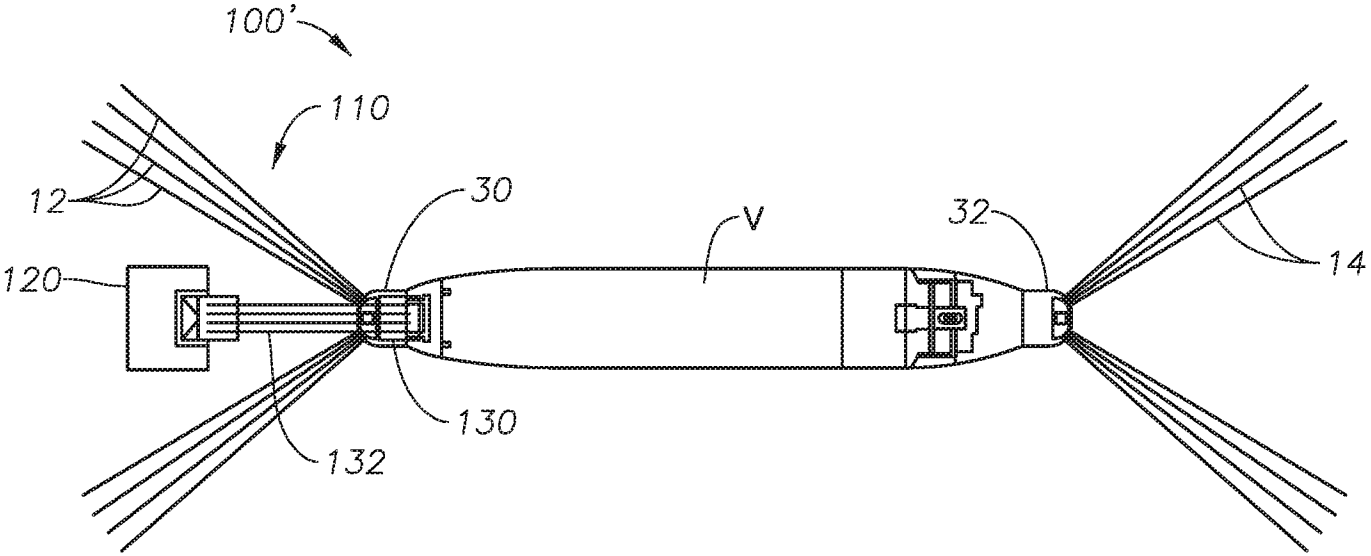
FIG. 12A is a plan view of an alternative configuration of the disconnectable spread mooring and riser tower system with the riser tower at the bow or stern of the vessel.
Figure 12B:
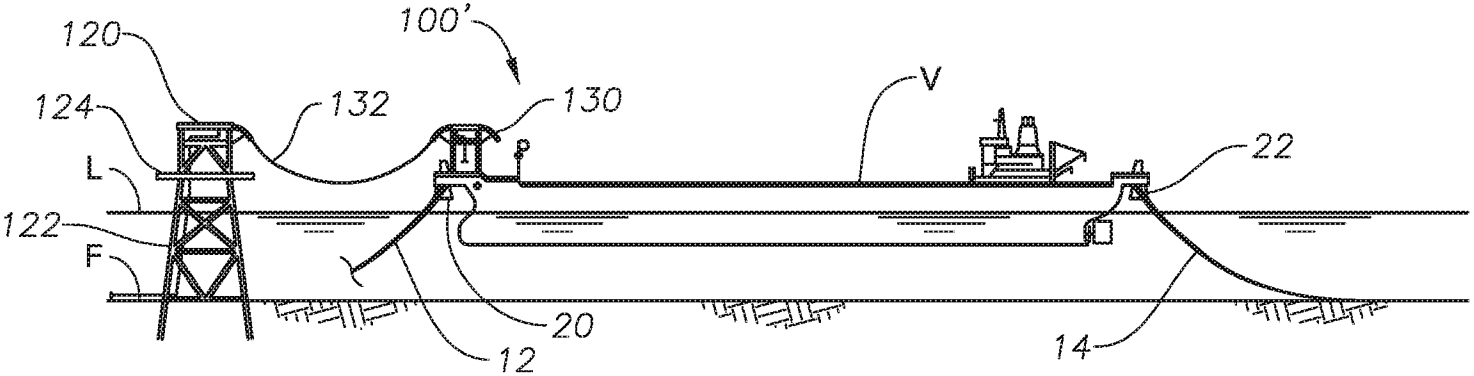
FIG. 12B is a side elevation view of the alternative configuration of the disconnectable spread mooring and riser tower system at the bow or stern of the vessel.

FIGS. 12A and 12B illustrate an alternative configuration of the disconnectable spread mooring and riser tower system 100' with the riser tower system 120 at the bow of the vessel V. The jumper support structure 130 is located at the bow of the vessel V, preferably adjacent to or on the forward chain table support structure 30, as opposed to being located along the mid-section of the vessel V as in FIG. 4A.

Referring to FIG. 12A, the bow anchor legs 12 are placed forward of the vessel V to the starboard and port sides of the vessel V, preferably using tug boats or work boats, with the riser tower system 120 directly in front of the bow. Similarly, the stern anchor legs 14 are placed rearward of the vessel V to the starboard and port sides of the vessel V. With the bow and stern anchor legs in place, the jumper hoses and cables 132 can span between the riser tower decks 124 and the jumper support structure 130 of the vessel V.

The sequence of steps involved in moving the vessel V off location in this alternative configuration is very similar to the sequence described above with respect to FIGS. 8-10. Initially, all the jumper hoses and cables 132 spanning between the riser tower decks 124 and the jumper support structure 130 of the vessel V are disconnected and pulled onto the vessel V or onto the riser tower 120. Preferably, the forward disconnectable chain table assembly 20 with bow mooring legs 12 near the riser tower 120 is disconnected first in the manner described above. The aft disconnectable chain table assembly 22 with stem mooring legs 14 is then disconnected as described above. If the stern of the vessel V is initially placed near the riser tower 120, the aft chain table assembly 22 with stem mooring legs 14 will be disconnected first. The vessel V may then use its own power to move away from the riser tower system 120 and then can sail away to a safe harbor.

It is to be understood that reconnecting the disconnectable spread mooring system 110 upon the vessel V returning to the location may be accomplished as described above with respect to FIG. 11.

Figure 5B:
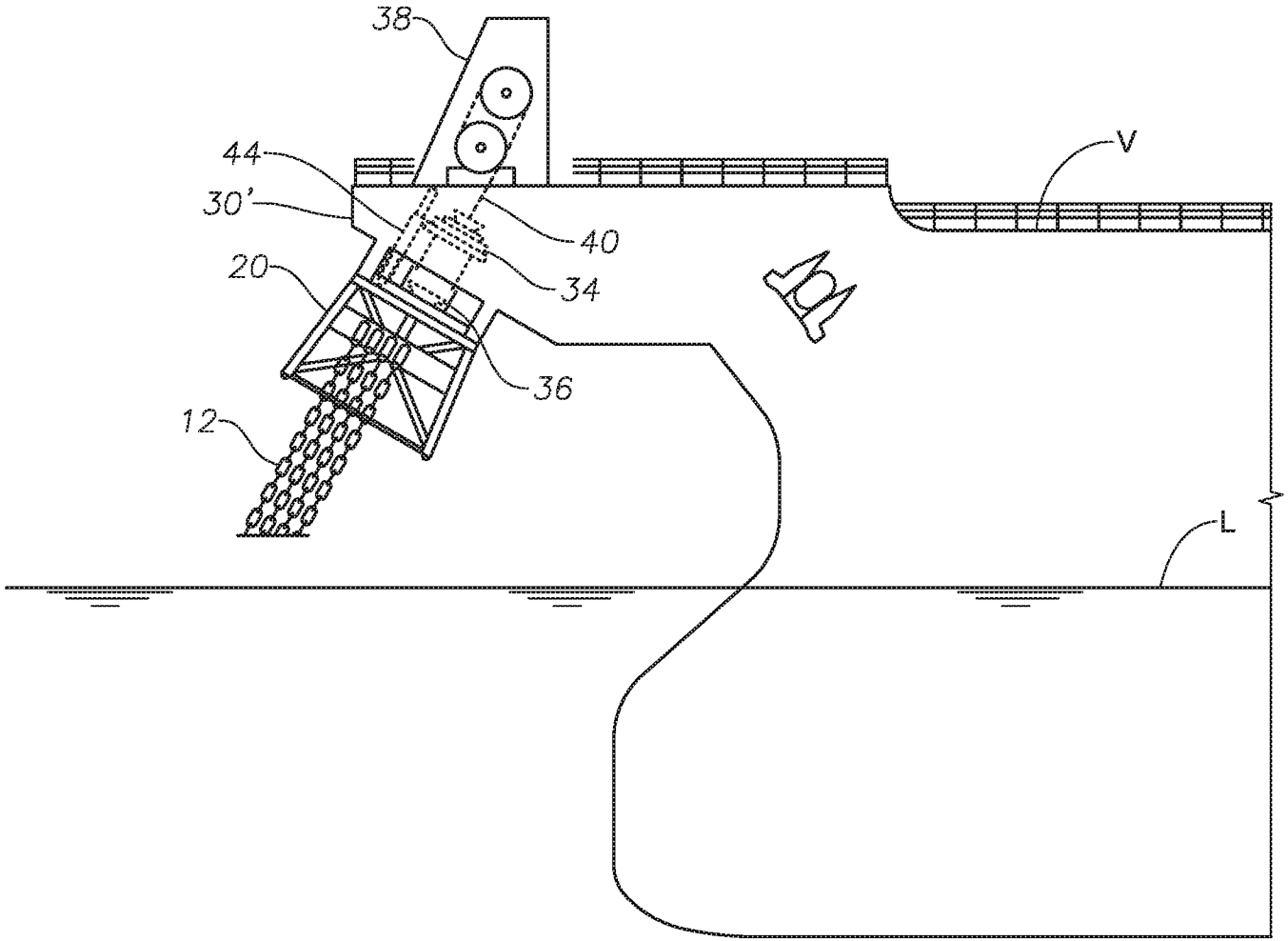
FIG. 5B is a partial side elevation view showing a forward chain table assembly connected to a forward connector assembly at an angle from vertical.

FIG. 5B discloses an alternative orientation for the disconnectable chain table assembly 20 shown in FIG. 5A. In FIG. 5B, the disconnectable chain table assembly 20 is connected to a chain table support structure 30' at an angle with respect to vertical. The hydraulic connector assembly 34 is also oriented at an angle with respect to vertical and the winch assembly 38 is preferably positioned such that the winch wire 40 is in coaxial alignment with the connector assembly 34. The alignment pin assembly 44 is similarly angled. The remaining components may be the same as discussed with respect to FIG. 5A.

One purpose for the angled connection of FIG. 5B is to aid in the reconnection operation of the disconnectable chain table assembly 20 with the connector assembly 34. As shown in FIG. 5B, the bow mooring legs 12 all generally extend forward of the bow of the vessel V. As the disconnectable chain table assembly 20 is retrieved and pulled in to the connector assembly 34, a large moment is produced and the chain table assembly 20 with connector hub 36 is not vertical, but angled. By placing the connection at an appropriate angle with respect to vertical, the moment does not have to be overcome on making the connection with the connector assembly 34. It is to be understood that this may also be applicable to the aft disconnectable chain table assembly 22 and the connection at the stem of the vessel V.

Figure 5C:
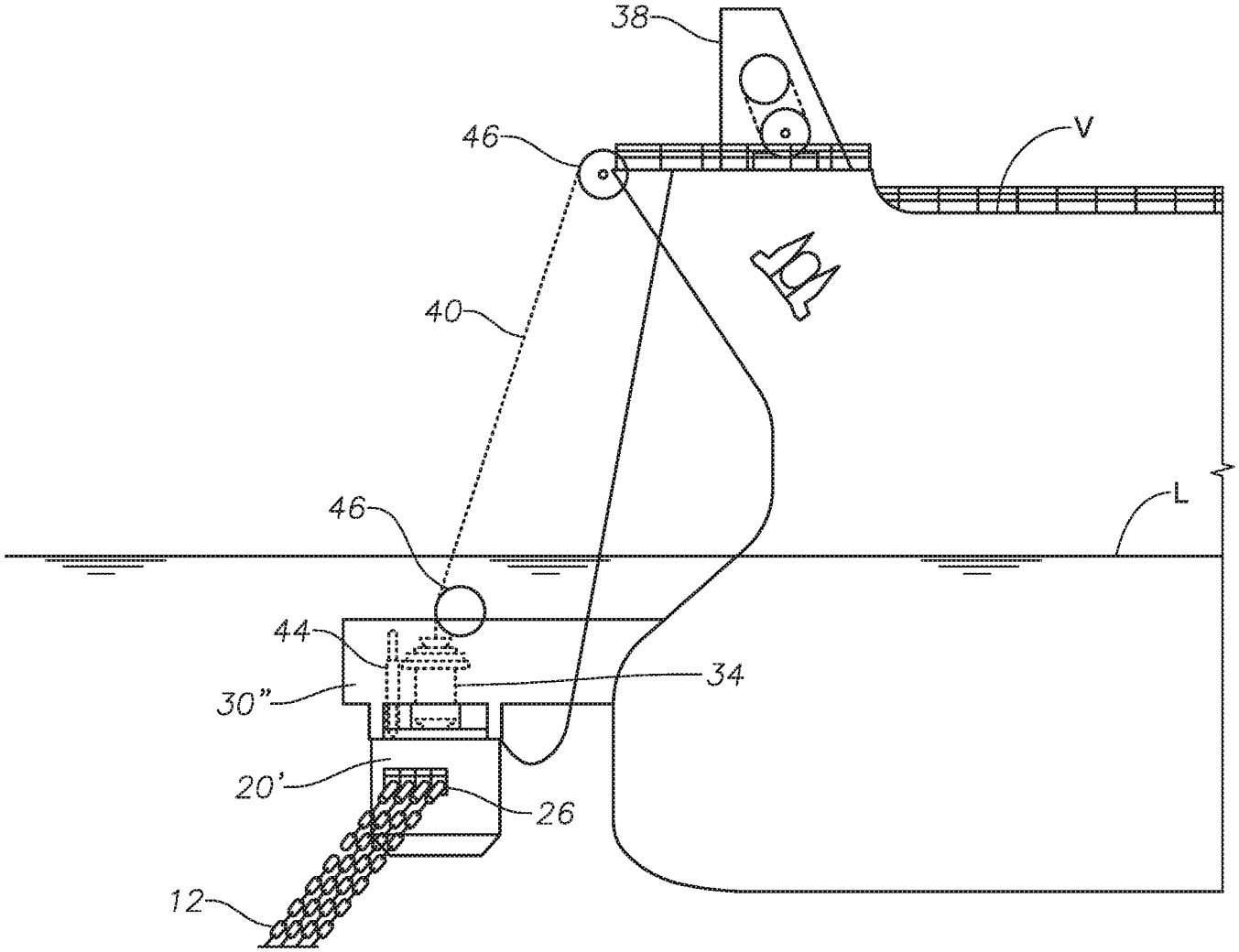
FIG. 5C is a partial side elevation view showing a forward chain table assembly connected to a forward connector assembly submerged in water.

FIG. 5C illustrates another embodiment in which a forward disconnectable chain table assembly 20', the connector assembly 34 and a forward chain table support structure 30" are below the water line L. Preferably, the winch assembly 38 is mounted on the bow of the vessel V and a guide member or members 46 provide guidance of the winch line 40 from the winch assembly 38 to the chain table support structure 30". It is understood that the chain table assemblies (without buoyancy compartments) may be mounted partially or fully submerged as shown in FIG. 5C and released to the seafloor F and retrieved from the seafloor F as described above and as illustrated in FIGS. 9 and 11. It is also to be understood that this is also applicable to the aft disconnectable chain table assembly 22 and the connection at the stern of the vessel V.

Figure 13A:
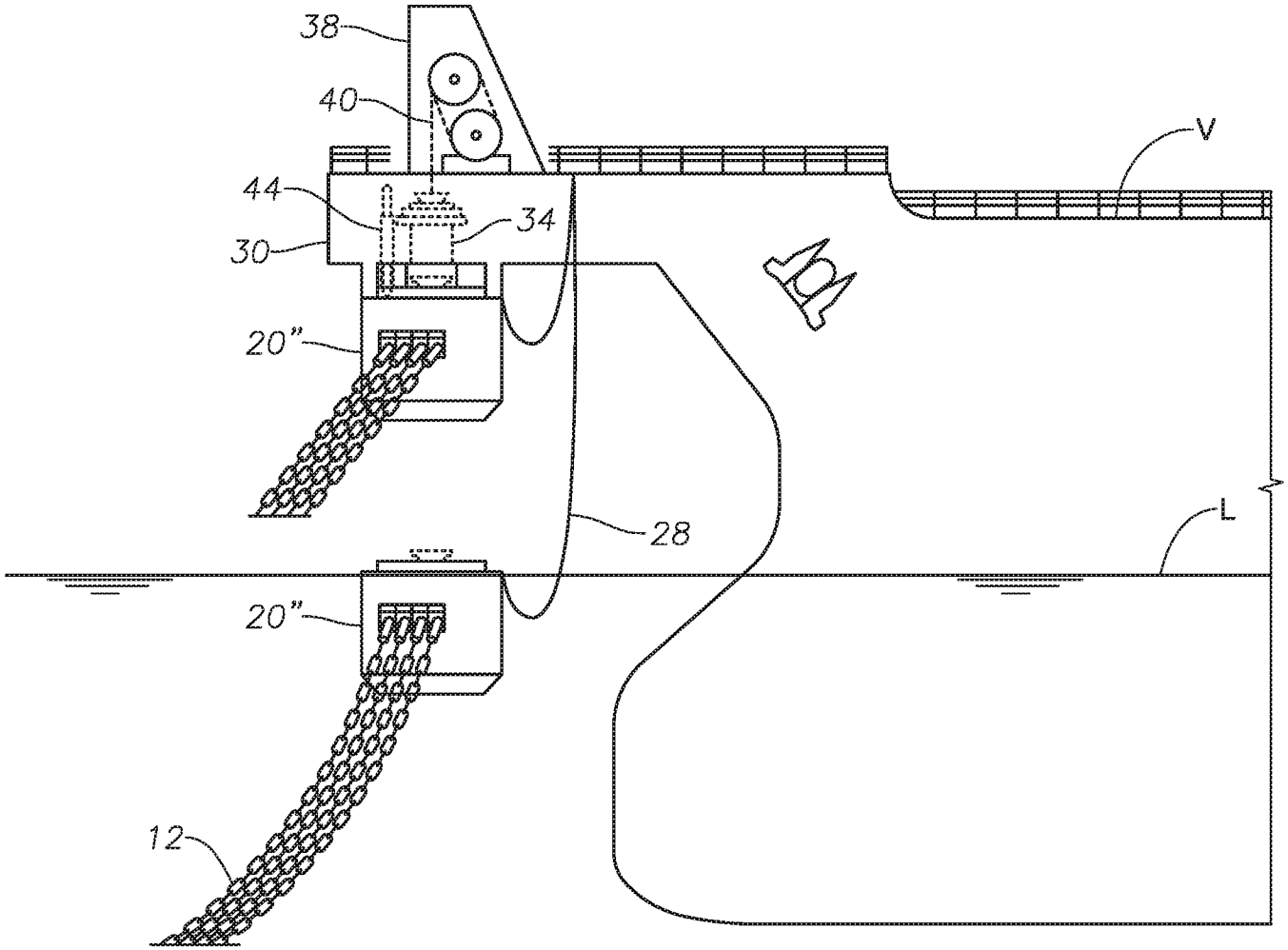
FIG. 13A is a partial side elevation view showing a buoyant forward chain table assembly connected to a forward connector assembly above the waterline, and showing the buoyant forward chain table assembly released from the forward connector assembly and floating in the water.
Figure 13B:
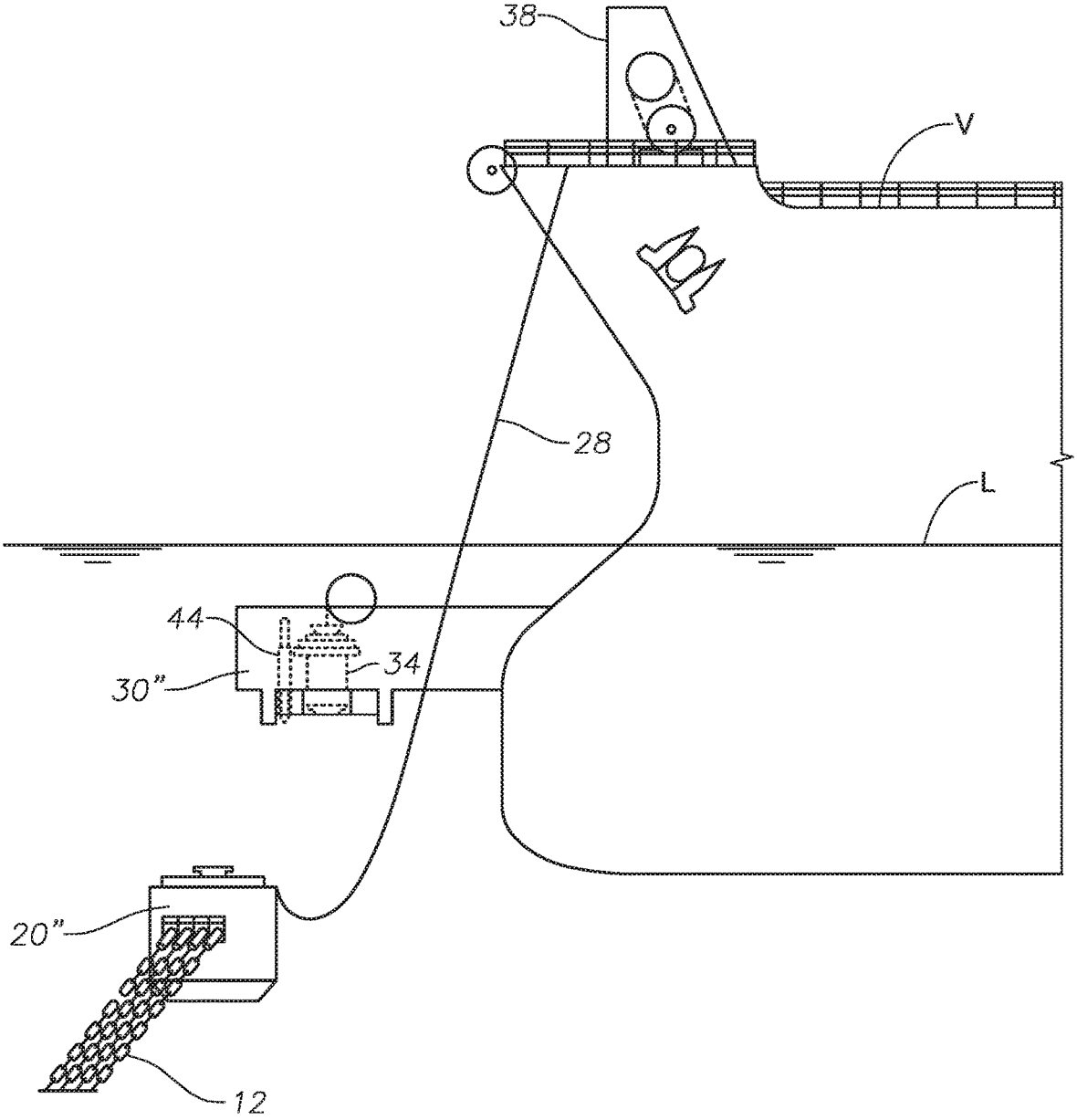
FIG. 13B is view similar to FIG. 5C, showing a submerged chain table assembly with buoyancy compartments released from the connector assembly and floating submerged at neutral buoyancy.
Figure 13C:
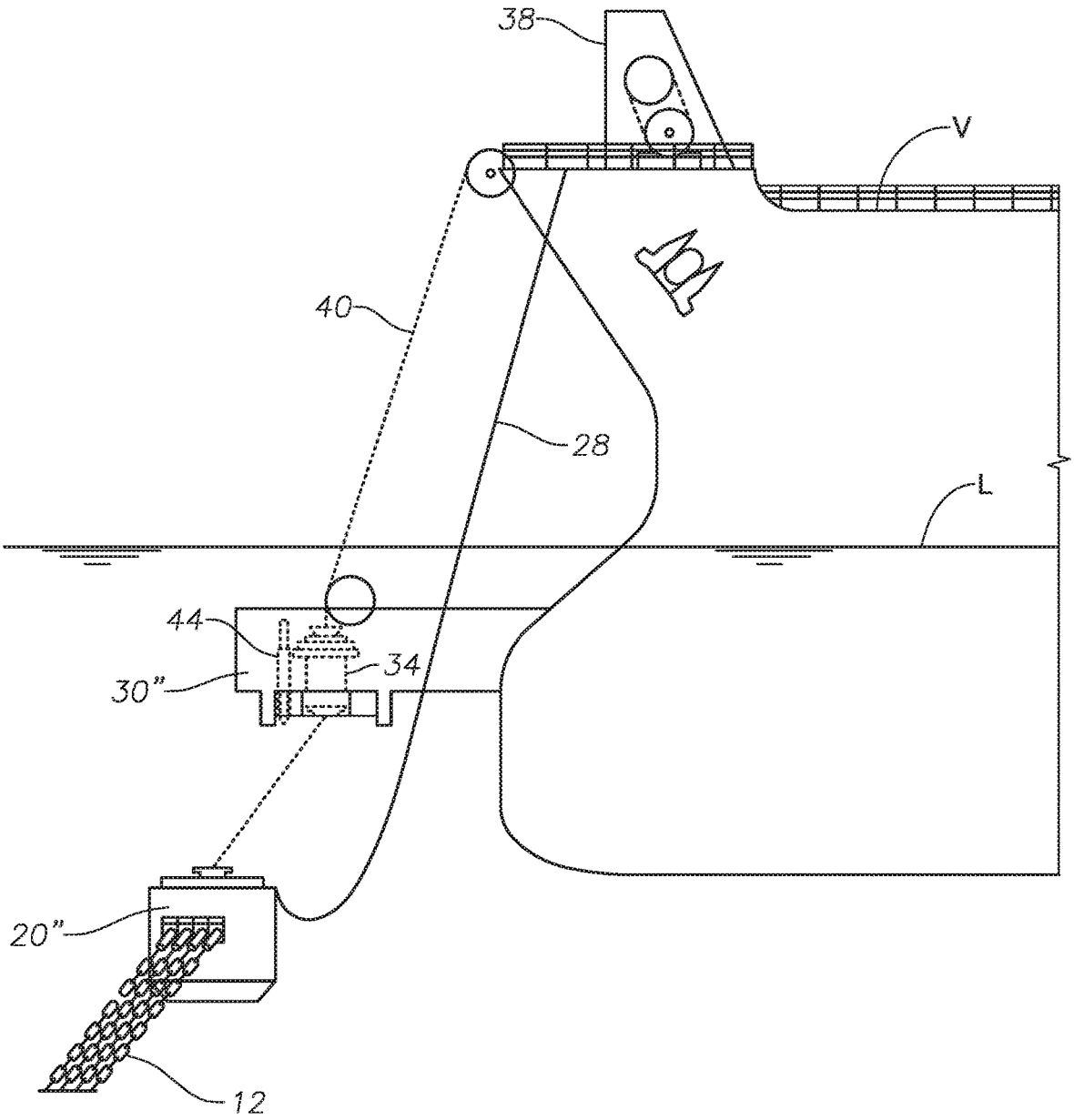
FIG. 13C is view similar to FIG. 13B, showing the submerged chain table assembly with buoyancy compartments being pulled-in to the submerged connector assembly.

FIGS. 13A, 13B and 13C disclose other embodiments having forward and aft chain table assemblies with buoyancy compartments, referred to as 20" and 22" respectively. In FIG. 13A, the buoyant forward chain table assembly 20" connects to a forward connector assembly 34 above the water line L, similar to the arrangement in FIG. 5A. A tie-back hawser 28 has one end connected to the buoyant forward chain table assembly 20" with the other end secured to the vessel V. It is to be understood that the buoyant forward chain table assembly 20", upon disconnection from the connector assembly 34, is lowered into the water with the winch assembly 38 and allowed to float at or near the water line L. The winch wire 40 is then disconnected and the tie-back hawser 28 continues to connect the floating chain table assembly 20" to the vessel V. The buoyant aft disconnectable chain table assembly 22" is similarly lowered and allowed to float at or near the water line L with a hawser 28 connected to it.

Figure 14:
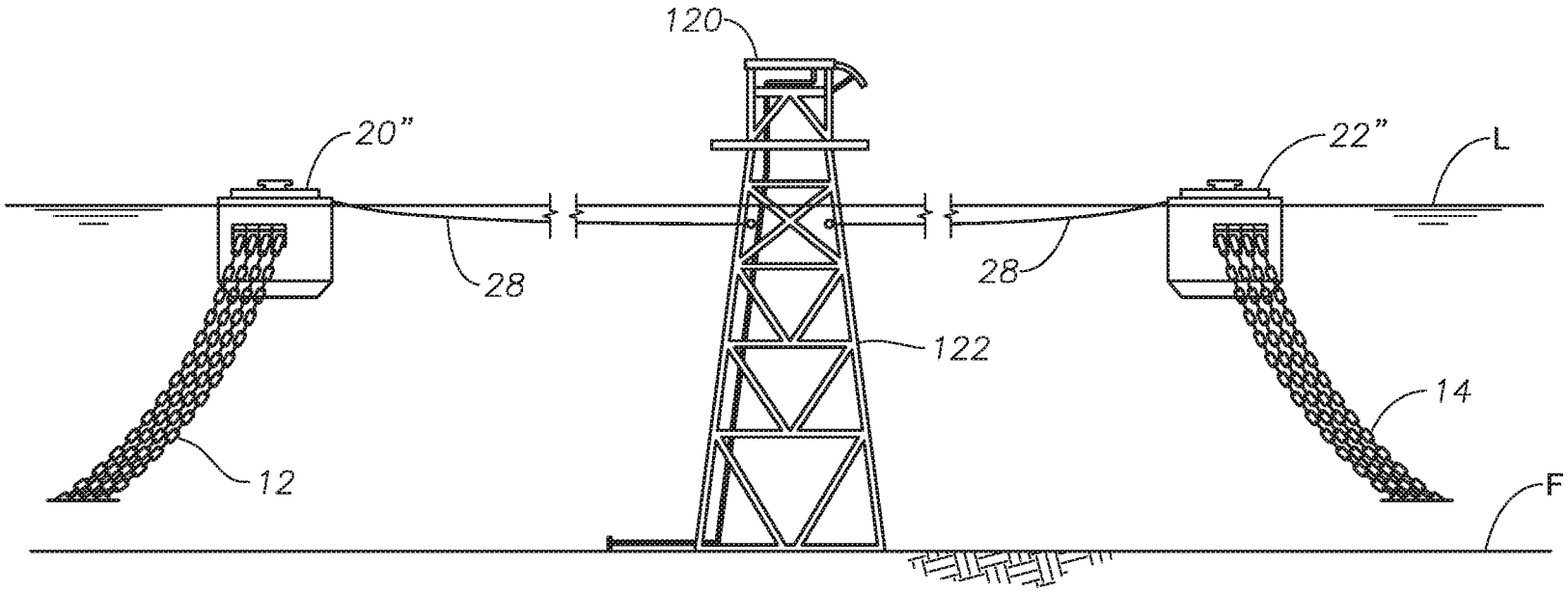
FIG. 14 is an elevation view showing floating chain table assemblies with buoyancy compartments connected with tie-back hawsers to a fixed structure, such as a riser tower.

In a mooring and tower arrangement as shown in FIGS. 4A-4C and with the forward and aft buoyant disconnectable chain table assemblies 20" and 22" lowered and floating at or near the water line L, the free end of the hawser 28 connected to each chain table assembly 20", 22" may be connected to a fixed structure, as for example the fixed jacket structure 122 of the riser tower system 120, for the period of time the vessel V is off location, as shown in FIG. 14. It is to be understood that the hawser 28 could alternatively be a chain or a combination of hawser and chain.

Alternatively, and in addition to other mooring and tower arrangements, the buoyant disconnected chain table assemblies 20", 22" may be connected to a buoy secured to the seabed with a mooring line by conventional offshore operations.

In FIG. 13B, the forward chain table assembly with buoyancy compartment 20" connects to a submerged forward connector assembly 34 mounted to a submerged forward chain table support structure 30", similar to the arrangement shown in FIG. 5C. In FIG. 13B, the submerged forward disconnectable chain table assembly with buoyancy compartment 20" is released from the hydraulic connector assembly 34 and allowed to submerge further into the water until it reaches neutral buoyancy. A tie-back hawser 28 has one end connected to the chain table assembly 20" and has a second end on the vessel V. The submerged aft disconnectable chain table assembly 22" is similarly released and allowed to submerge further into the water until it reaches neutral buoyancy with a hawser 28 connected to it.

Figure 15:
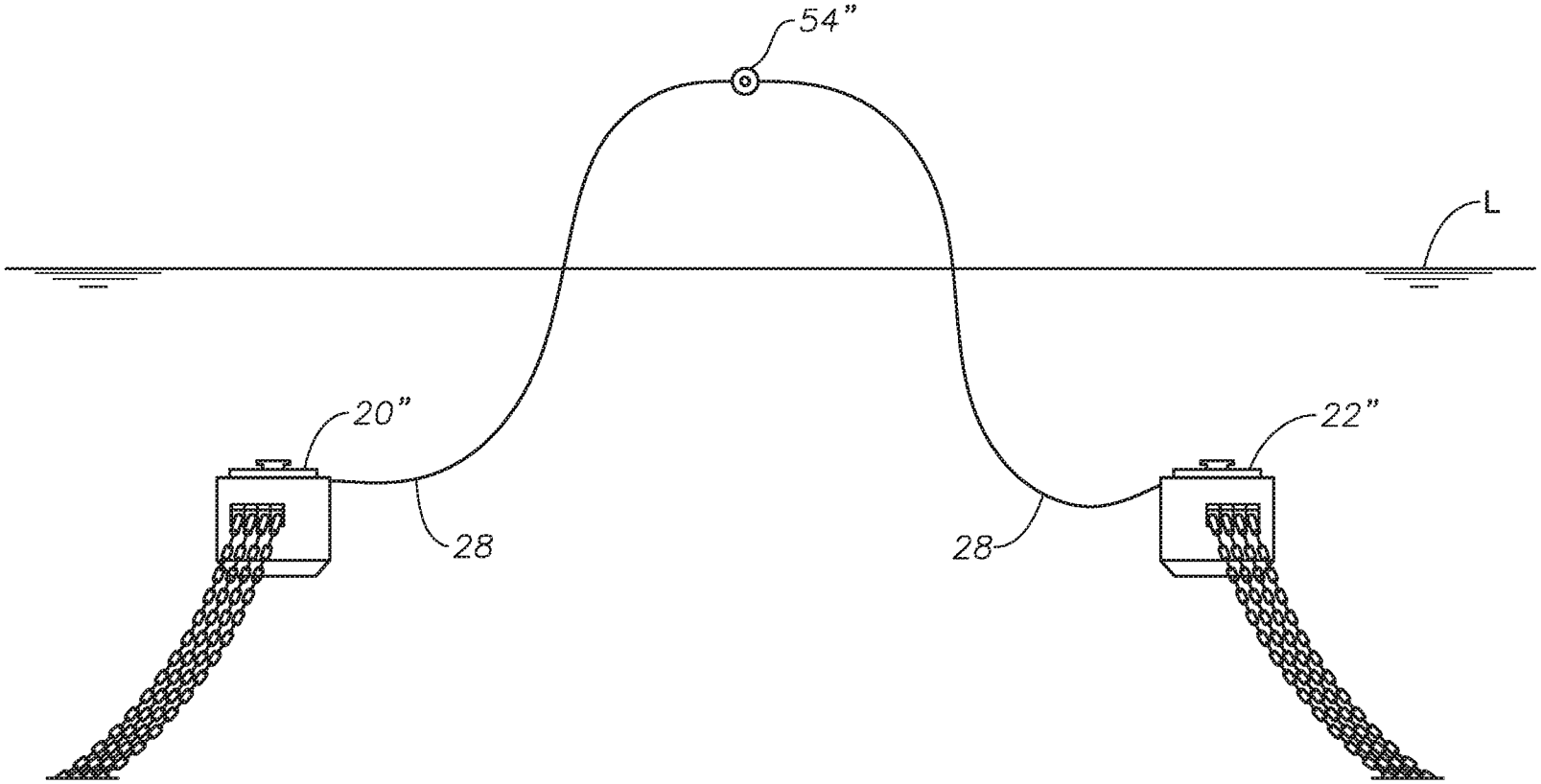
FIG. 15 is an elevation view of a connection arrangement to connect the preinstalled tie-back hawsers together on the vessel by a mooring connector.
Figure 16:
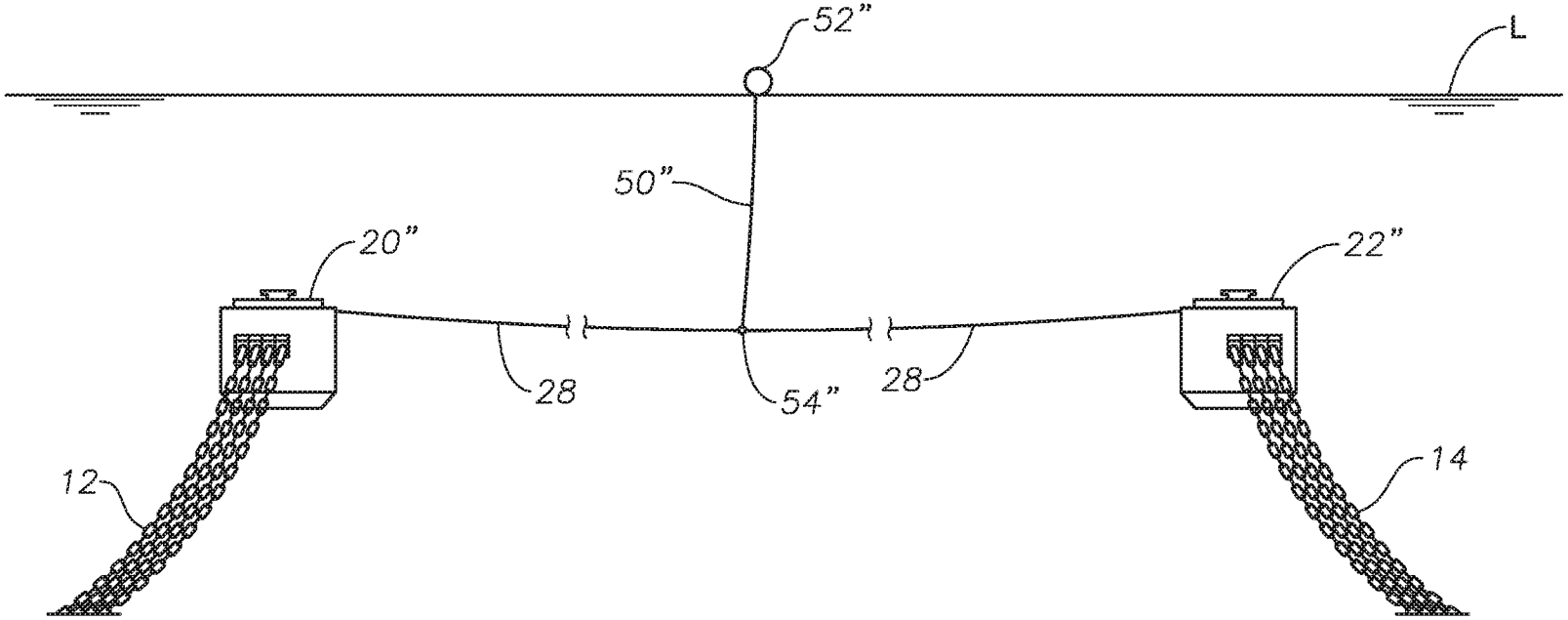
FIG. 16 is an elevation view showing submerged chain table assemblies with buoyancy compartments connected with tie-back hawsers and floating in water with a marine light and retrieval line.

Referring to FIG. 15, with the buoyant disconnectable chain table assembles 20", 22" floating in the water, both tie-back hawsers 28 can be pulled-in on the vessel V with winch assemblies (not shown) and connected to each other by a conventional offshore hardware/rope link assembly 54", preferably with a quick release hook or shark jaws. A retrieval rope 50" (FIG. 16) has one end connected to the tie-back hawser/hardware/rope 54", and a second end connected to the winch line of the winch assembly. Preferably, a tag line with a surface buoy/light 52" is also attached to the retrieval line 50". The connected hawsers 28 and retrieval line 50" and tag line with buoy/light 52" are lowered into the water by the winch assembly and released, as shown in FIG. 16.

The reconnection procedures follow the reverse of the disconnection procedures. The tag line with surface buoy/light 52" is retrieved and the hawsers 28 are disconnected from one another. Referring to FIG. 13C, the winch wire 40 of the winch assembly 38 is passed through the connector assembly 34 of the chain table support structure 30" and the mating hub 70 of the chain table assembly 20". The winch assembly 38 is used to draw in the chain table assembly 20" to the chain table support structure 30". When pulled in, the hydraulic connector assembly 34 is actuated to engage with the mating hub 70.

Figure 17A:
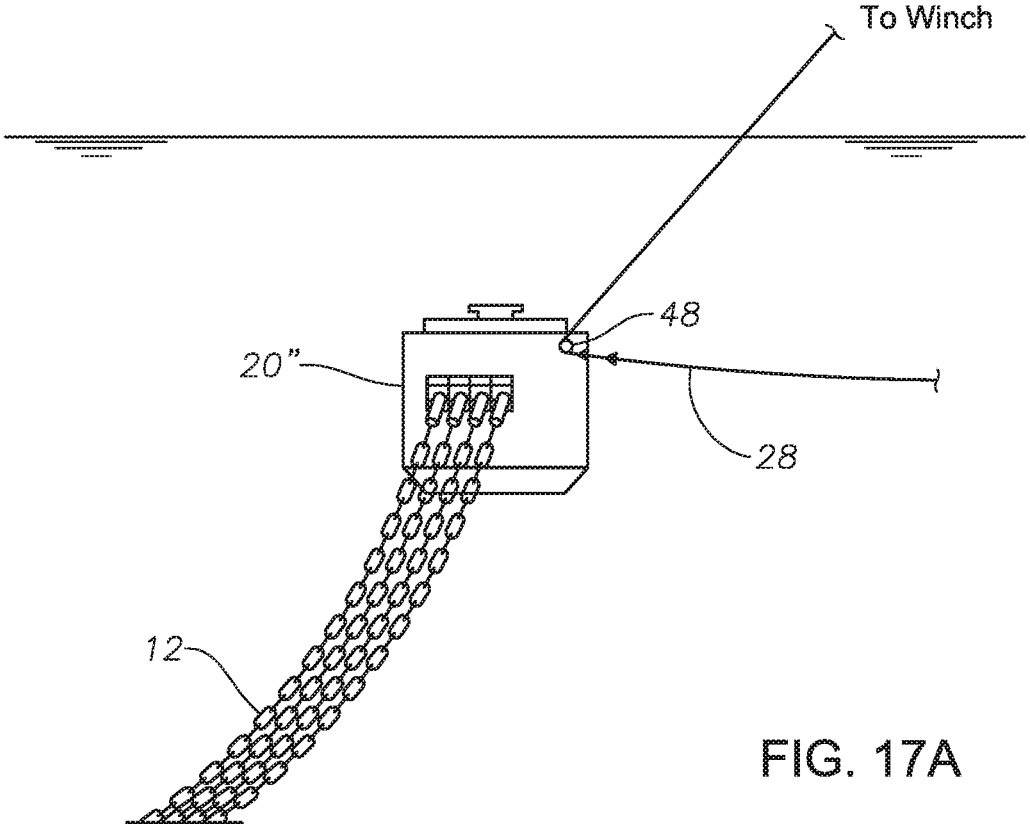
FIG. 17A is an elevation view of a connection arrangement for connecting chain table assemblies to one another one (as in FIG. 16) or to a fixed structure (as in FIG. 14) through a subsea mooring connector on a chain table assembly.
Figure 17B:
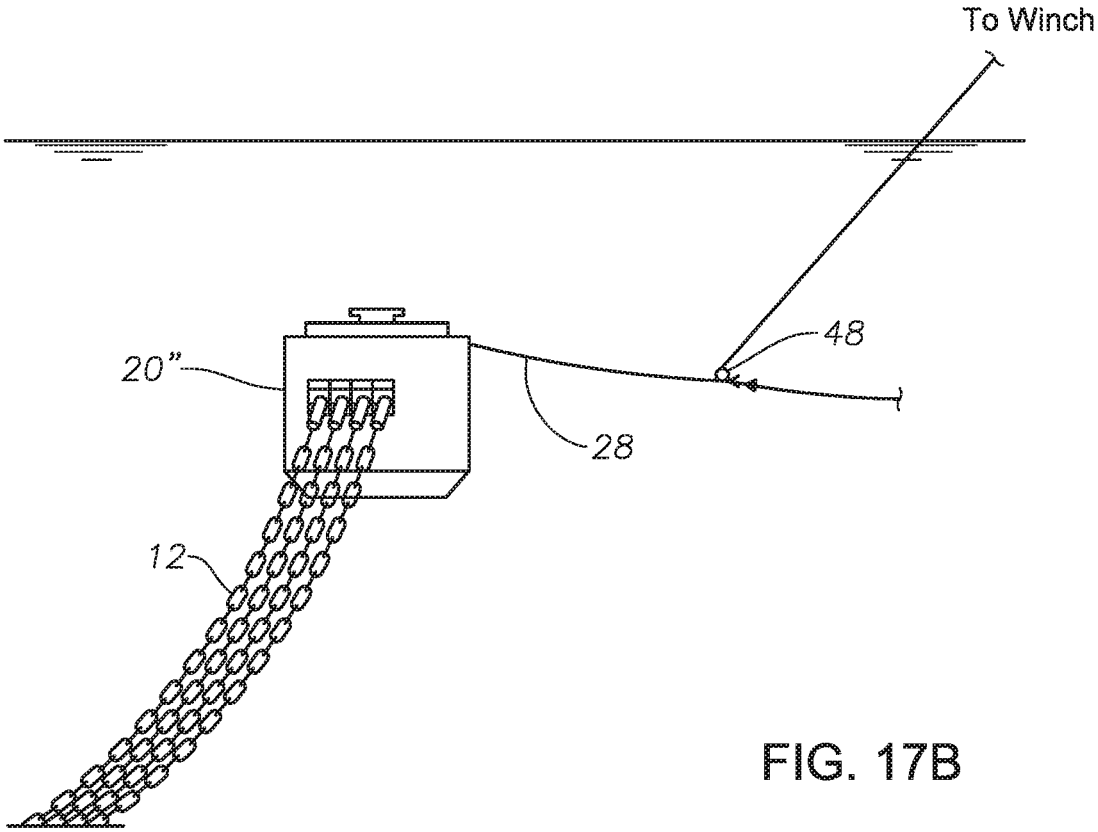
FIG. 17B is an elevation view of a connection arrangement for connecting chain table assemblies to one another one (as in FIG. 16) or to a fixed structure (as in FIG. 14) through a subsea mooring connector at the end of a tie-back hawser.

A guided subsea connector 48, preferably with a turndown shaft or a wheel, can also be utilized to connect the tie-back hawsers 28 together in the water or on the seabed by a winch line of a winch assembly on the vessel as shown in FIGS. 17A and 17B. The hawser 28 from the chain table assembly 20" with one side of the connector fixed at a pre-determined position is connected with the second hawser on the vessel, see FIG. 15, and dropped into the water. The second hawser, preinstalled and connected with the winch wire on the vessel, will pass through the connector 48 fixed on the second chain table assembly, see FIG. 17A, to be pulled-in for making a connection. The connector 48 can also be fixed at the end of the second hawser 28 and the winch wire will pass through for making a connection as shown in FIG. 17B.

Figure 18:
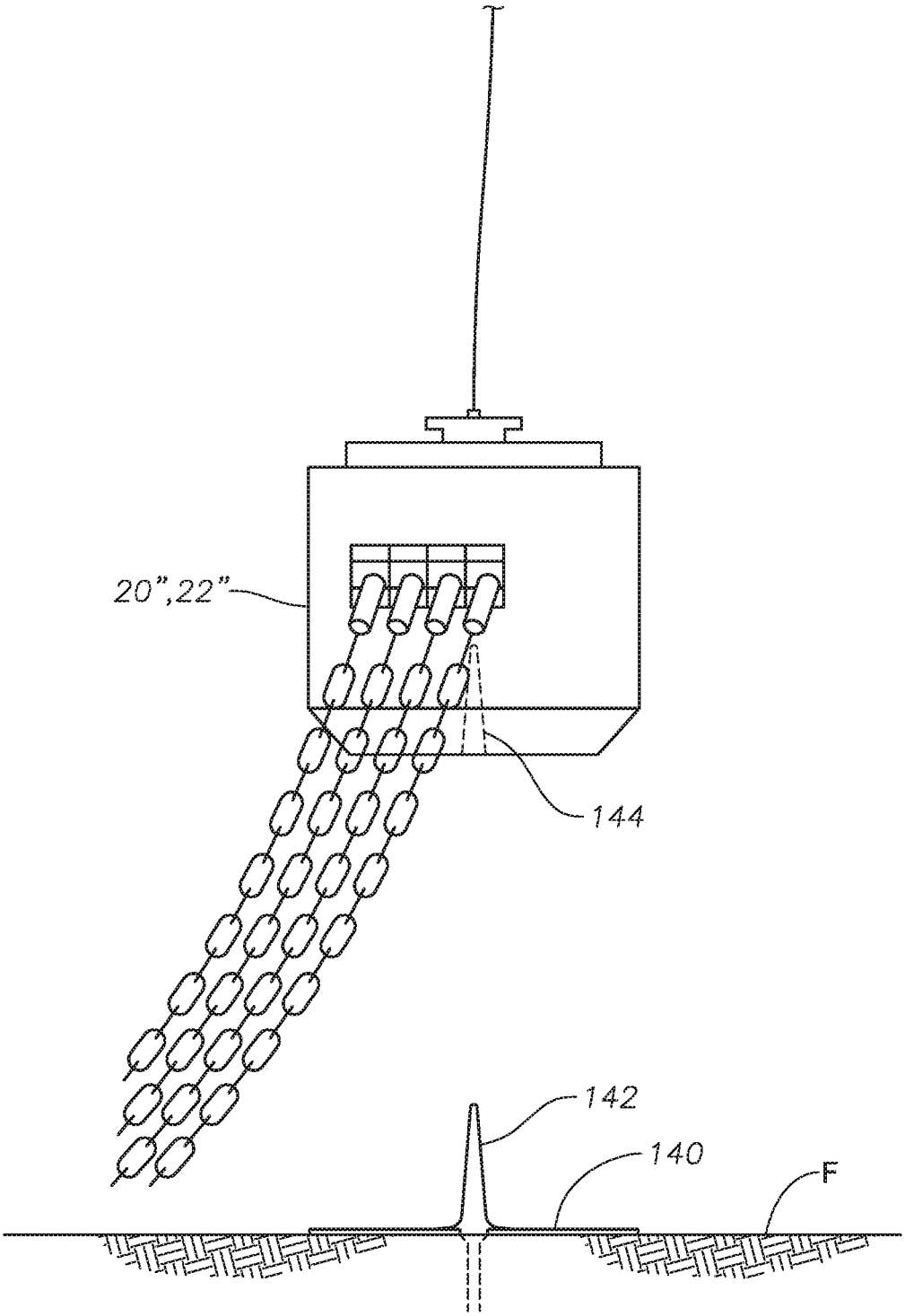
FIG. 18 is an elevation view of preinstalled mudmat and stabbing to be connected with a receptacle on a chain table assembly by a guided manner.

Alternatively, mudmats 140 with a large stabbing 142 on each are preinstalled on the seabed F near bow and stern areas. Referring to FIG. 18, a receptacle 144 in the center of each chain table assembly 20", 22" is used to set the chain table assembly on the stabbing 142. After disconnection from the connector assembly 34, each chain table assembly with buoyant compartment 20", 22" is pulled by the disconnected vessel close to the preinstalled mudmat 140 and then fully flooded to set down onto the stabbing 142 on the mudmat 140 in a guided manner. A remotely operated vehicle ("ROV") may be used to guide the chain table assembly 20", 22" onto the stabbing 142. The chain table assembly may be secured on the stabbing 142 with a devise. Upon reconnection, after removing the securing devises if any, air will be pumped into the buoyant compartments of the assembly 20", 22", preferably via an ROV, to bring it back to the connection height for reconnection. When the chain table assembly 20", 22", reaches its natural floating position, it can be pulled to the connector assembly 34 by winch assemblies 38.

Figure 13D:
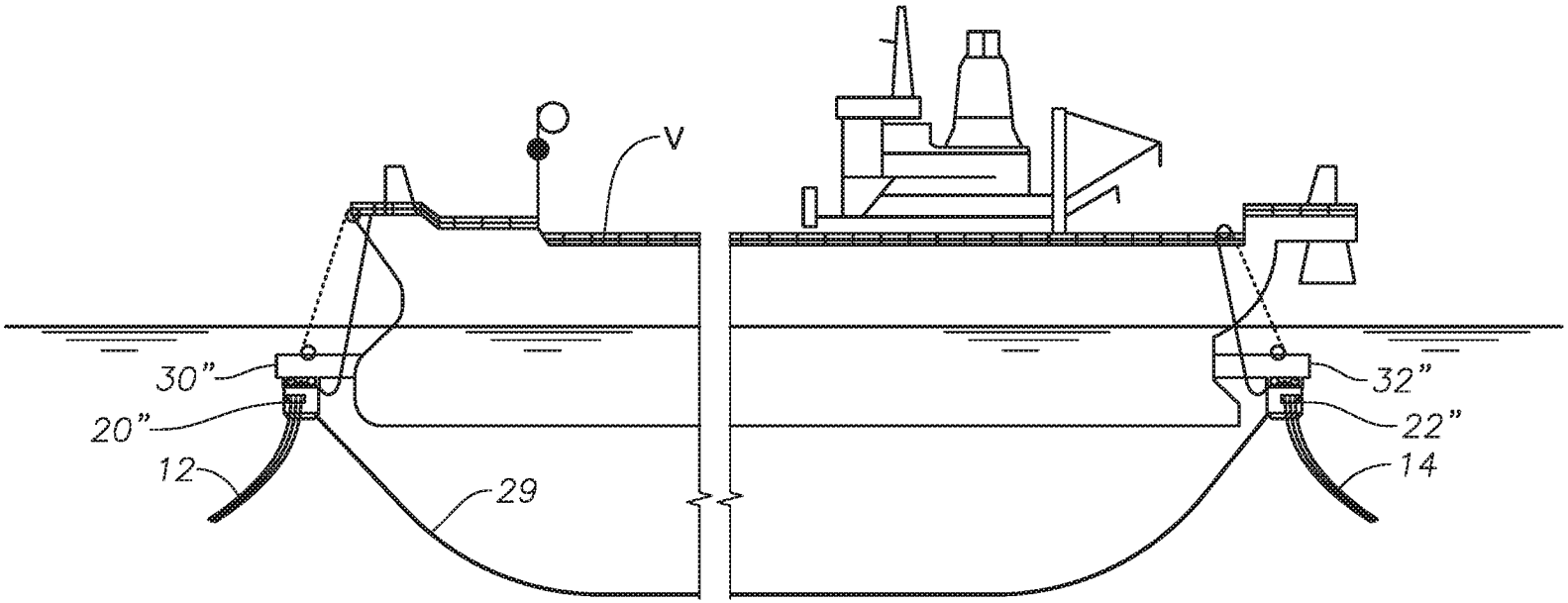
FIG. 13D is a side elevation view of an alternative embodiment showing forward and aft chain table assemblies with buoyancy compartments connected to the vessel, with the chain table assemblies being connected to one another with a preinstalled tie-back chain.
Figure 13E:
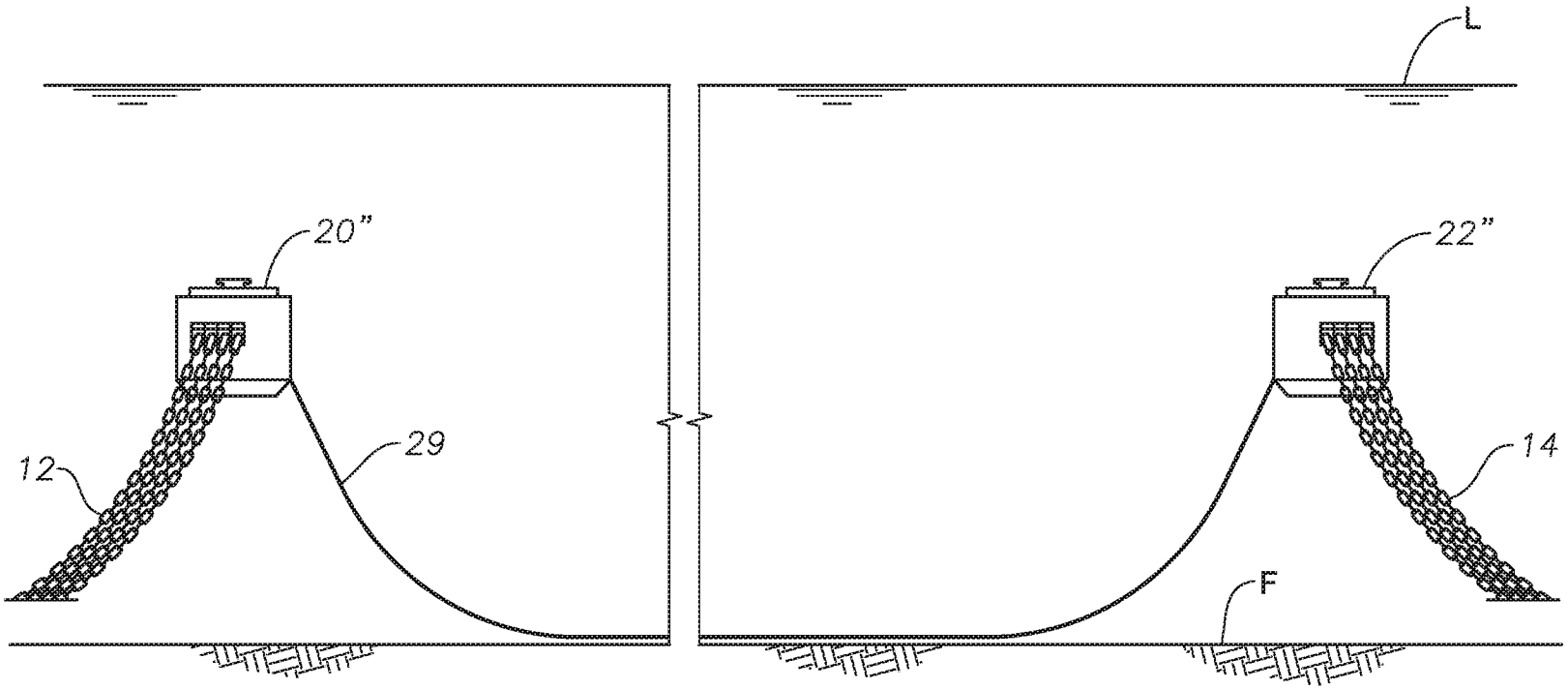
FIG. 13E is a side elevation view showing the forward and aft chain table assemblies with buoyancy compartments connected with the preinstalled tie-back chain in FIG. 13D and floating in water at neutral buoyancy after disconnection from the vessel.

FIGS. 13D and 13E disclose another embodiment having forward and aft chain table assemblies with buoyancy compartments, referred to as 20" and 22" respectively, submerged and connected with a pre-installed tie-back chain 29 underneath the vessel V. It is to be understood that the buoyant forward chain table assembly 20", upon disconnection from the connector assembly 34, submerges lower in the water and floats submerged at neutral buoyancy. The buoyant aft disconnectable chain table assembly 22" is similarly disconnected and allowed to float in the water at neutral buoyancy with the preinstalled tie-back chain 29 connected to both chain table assemblies 20" and 22" after disconnection as shown in FIG. 13E.

It is to be understood that offloading and loading operations can be operated by means of bow and stern tandem arrangement or alongside arrangement or CALM/SALM buoy system, or between the moored vessels and other facilities through the riser tower systems.

While the invention has been described in detail above with reference to specific embodiments, it will be understood that modifications and alterations in the embodiments disclosed may be made by those practiced in the art without departing from the spirit and scope of the invention. All such modifications and alterations are intended to be covered. In addition, all publications cited herein are indicative of the level of skill in the art and are hereby incorporated by reference in their entirety as if each had been individually incorporated by reference and fully set forth.

We claim:

1. A disconnectable spread mooring assembly for a vessel floating at a water surface, the vessel having a bow and a stern, the disconnectable spread mooring assembly comprising:

a forward chain table assembly releasably connected to the vessel at the bow;

an aft chain table assembly releasably connected to the vessel at the stern;

a plurality of bow mooring legs having first ends attached to the forward chain table assembly and having second ends capable of being anchored at spaced locations on a seafloor;

a plurality of stern mooring legs having first ends attached to the aft chain table assembly and having second ends capable of being anchored at spaced locations on the seafloor;

a first connector assembly connecting the forward chain table assembly to the vessel at the bow;

a second connector assembly connecting the aft chain table assembly to the vessel at the stern, wherein the first and second connector assemblies are arranged and designed to unlock and release the forward and aft chain table assemblies from the vessel;

a first pull-in assembly on the vessel at the bow; and a second pull-in assembly on the vessel at the stern, wherein the first pull-in assembly is arranged and designed to lower the forward chain table assembly and the first ends of the plurality of bow mooring legs from the vessel upon unlocking the first connector assembly, and the second pull-in assembly is arranged and designed to lower the aft chain table assembly and the first ends of the plurality of stern mooring legs from the vessel upon unlocking the second connector assembly.

2. The disconnectable spread mooring assembly of claim 1, wherein each of the forward and aft chain table assemblies comprises one or more buoyancy compartments and the forward and aft chain table assemblies are arranged and designed to float at or near the water surface when disconnected from the vessel.

3. A disconnectable spread mooring assembly for a vessel floating at a water surface, the vessel having a bow and a stern, the disconnectable spread mooring assembly comprising:

a forward chain table assembly releasably connected to the vessel at the bow;

an aft chain table assembly releasably connected to the vessel at the stern, wherein each of the forward and aft chain table assemblies comprises one or more buoyancy compartments and the forward and aft chain table assemblies are arranged and designed to float at or near the water surface when disconnected from the vessel;

a plurality of bow mooring legs having first ends attached to the forward chain table assembly and having second ends capable of being anchored at spaced locations on a seafloor;

a plurality of stern mooring legs having first ends attached to the aft chain table assembly and having second ends capable of being anchored at spaced locations on the seafloor;

a first connector assembly connecting the forward chain table assembly to the vessel at the bow;

a second connector assembly connecting the aft chain table assembly to the vessel at the stern, wherein the first and second connector assemblies are arranged and designed to unlock and release the forward and aft chain table assemblies from the vessel;

a first tie-back hawser or chain, or combination of hawser and chain, connected to the forward chain table assembly;

a second tie-back hawser or chain, or combination of hawser and chain, connected to the aft chain table assembly; and one or more fixed jacket structures fixed to the seafloor, wherein the first and second tie-back hawsers or chains, or combinations of hawser and chain, are arranged and designed to connect to the one or more fixed jacket structures when the forward and aft chain table assemblies float at or near the water surface.

4. The disconnectable spread mooring assembly of claim 2, further comprising:

a first tie-back hawser or chain, or combination of hawser and chain, connected to the forward chain table assembly;

a second tie-back hawser or chain, or combination of hawser and chain, connected to the aft chain table assembly; and one or more buoys secured to the seafloor, wherein the first and second tie-back hawsers or chains, or combinations of hawser and chain, are arranged and designed to connect to the one or more buoys when the forward and aft chain table assemblies float at or near the water surface.

5. The disconnectable spread mooring assembly of claim 1, wherein each of the forward and aft chain table assemblies comprises one or more buoyancy compartments and the forward and aft chain table assemblies are arranged and designed to float submerged below the water surface at neutral buoyancy when disconnected from the vessel.

6. The disconnectable spread mooring assembly of claim 5, further comprising:

a first tie-back hawser or chain, or combination of hawser and chain, connected to the forward chain table assembly; and a second tie-back hawser or chain, or combination of hawser and chain, connected to the aft chain table assembly, wherein the first and second tie-back hawsers or chains, or combinations of hawser and chain, are arranged and designed to connect to one another and be submerged when the forward and aft chain table assemblies float submerged below the water surface at neutral buoyancy.

7. The disconnectable spread mooring assembly of claim 5, further comprising:

a tie-back chain or wire or combination of chain and wire, connected to the forward chain table assembly and the aft chain table assembly when the vessel is in the moored condition with the forward and aft chain table assemblies connected to the vessel, wherein the tie-back chain or wire or combination of chain and wire is arranged and designed to secure the forward and aft chain table assemblies when disconnected from the vessel and floating submerged below the water surface at neutral buoyancy.

8. The disconnectable spread mooring assembly of claim 7, wherein the tie-back chain or wire or combination of chain and wire, is positioned below the vessel when the vessel is in the moored condition.

9. The disconnectable spread mooring assembly of claim 1, wherein the first pull-in assembly is arranged and designed to lower the released forward chain table assembly and the first ends of the plurality of bow mooring legs to the seafloor, and the second pull-in assembly is arranged and designed to lower the released aft chain table assembly and the first ends of the plurality of stern mooring legs to the seafloor.

10. The disconnectable spread mooring assembly of claim 1, wherein the first and second pull-in assemblies are arranged and designed to retrieve the forward and aft chain table assemblies, respectively, released from the vessel for reconnection to the first and second connector assemblies, respectively.

11. The disconnectable spread mooring assembly of claim 1, further comprising:

a forward chain table support structure housing the first connector assembly at the bow of the vessel; and an aft chain table support structure housing the second connector assembly at the stern of the vessel.

12. The disconnectable spread mooring assembly of claim 1, wherein the forward and aft chain table assemblies are vertically oriented when connected to the first and second connector assemblies, respectively.

13. The disconnectable spread mooring assembly of claim 1, wherein the forward and aft chain table assemblies, when connected to the first and second connector assemblies, respectively, are above the water surface.

14. The disconnectable spread mooring assembly of claim 1, wherein the forward and aft chain table assemblies, when connected to the first and second connector assemblies, respectively, are partially submerged or fully submerged below the water surface.

15. The disconnectable spread mooring assembly of claim 1, wherein the first pull-in assembly comprises a winch assembly, hydraulic cylinders, a chain jack assembly, or a combination thereof at the bow of the vessel, and the second pull-in assembly comprises a winch assembly, hydraulic cylinders, a chain jack assembly, or a combination thereof at the stern of the vessel.

16. A disconnectable spread mooring and riser tower system for a vessel floating at a water surface, the vessel having a bow and a stern, the disconnectable spread mooring and riser tower system comprising:

a forward chain table assembly releasably connected to the vessel at the bow;

an aft chain table assembly releasably connected to the vessel at the stern;

a plurality of bow mooring legs having first ends attached to the forward chain table assembly and having second ends capable of being anchored at spaced locations on a seafloor;

a plurality of stern mooring legs having first ends attached to the aft chain table assembly and having second ends capable of being anchored at spaced locations on the seafloor;

a first connector assembly connecting the forward chain table assembly to the vessel at the bow;

a second connector assembly connecting the aft chain table assembly to the vessel at the stern, wherein the first and second connector assemblies are arranged and designed to unlock and release the forward and aft chain table assemblies from the vessel;

a first pull-in assembly on the vessel at the bow;

a second pull-in assembly on the vessel at the stern, wherein the first pull-in assembly is arranged and designed to lower the forward chain table assembly and the first ends of the plurality of bow mooring legs from the vessel upon unlocking the first connector assembly, the second pull-in assembly is arranged and designed to lower the aft chain table assembly and the first ends of the plurality of stern mooring legs from the vessel upon unlocking the second connector assembly;

a riser tower system fixed to the seafloor and located near the moored vessel; and one or more flexible jumper hoses extending between the riser tower system and the vessel to transfer one or more of: fluids, air, power and control signals.

17. A method for disconnecting a floating vessel having a bow and a stern from a spread mooring system at a moored location, the spread mooring system including a plurality of bow mooring legs anchored at spaced locations on a seafloor and connected to a forward chain table assembly connected to the vessel at the bow, and a plurality of stern mooring legs anchored at spaced locations on the seafloor and connected to an aft chain table assembly connected to the vessel at the stern, the method comprising the steps of:

unlocking a first connector assembly securing the forward chain table assembly to the vessel;

releasing the forward chain table assembly from the first connector assembly and lowering the forward chain table assembly with a first pull-in assembly into the water;

unlocking a second connector assembly securing the aft chain table assembly to the vessel;

releasing the aft chain table assembly from the second connector assembly and lowering the aft chain table assembly with a second pull-in assembly into the water;

securing the positioning of the forward and aft chain table assemblies in the water; and moving the vessel to another location with the forward and aft chain table assemblies and pluralities of bow and stern mooring legs remaining at the moored location.

18. The method for disconnecting a floating vessel of claim 17, wherein the step of securing the positioning of the forward and aft chain table assemblies in the water comprises lowering the forward chain table assembly with the first pull-in assembly to the seafloor and placing it on the seafloor and lowering the aft chain table assembly with the second pull-in assembly to the seafloor and placing it on the seafloor.

19. The method for disconnecting a floating vessel of claim 17, wherein the forward and aft chain table assemblies are buoyant, the spread mooring system further comprising a first tie-back hawser or chain, or combination of hawser and chain having a first end connected to the forward chain table assembly and a second tie-back hawser or chain, or combination of hawser and chain having a first end connected to the aft chain table assembly, wherein the step of securing the positioning of the forward and aft chain table assemblies in the water comprises connecting a second end of each of the first and second tie-back hawsers or chains, or combinations of hawser and chain, to one or more fixed jacket structures with the forward and aft chain table assemblies floating at or near the water surface.

20. The method for disconnecting a floating vessel of claim 17, wherein the forward and aft chain table assemblies are buoyant, the spread mooring system further comprising a first tie-back hawser or chain, or combination of hawser and chain having a first end connected to the forward chain table assembly and a second tie-back hawser or chain, or combination of hawser and chain having a first end connected to the aft chain table assembly, wherein the step of securing the positioning of the forward and aft chain table assemblies in the water comprises connecting a second end of each of the first and second tie-back hawsers or chains, or combinations of hawser and chain, to one or more buoys secured to the seafloor with the forward and aft chain table assemblies floating at or near the water surface.

21. The method for disconnecting a floating vessel of claim 17, wherein the forward and aft chain table assemblies each comprises one or more buoyancy compartments, the spread mooring system further comprising a first tie-back hawser or chain, or combination of hawser and chain having a first end connected to the forward chain table assembly and a second tie-back hawser or chain, or combination of hawser and chain having a first end connected to the aft chain table assembly, and wherein the step of securing the positioning of the forward and aft chain table assemblies in the water comprises:

connecting a second end of each of the first and second tie-back hawsers or chains, or combinations of hawser and chain, to one another; and allowing the forward and aft chain table assemblies to float submerged below the water surface at neutral buoyancy.

22. The method for disconnecting a floating vessel of claim 17, wherein the forward and aft chain table assemblies each comprises one or more buoyancy compartments, the spread mooring system further comprising a tie-back chain, wire or combination of chain and wire connected at a first end to the forward chain table assembly and connected to the aft chain table assembly at a second end, and wherein the step of securing the positioning of the forward and aft chain table assemblies in the water comprises following the steps of releasing the forward and aft chain table assemblies from the first and second connector assemblies, allowing the forward and aft chain table assemblies to float submerged below the water surface at neutral buoyancy, while being connected to the tie-back chain or wire or combination of chain and wire.

23. The disconnectable spread mooring assembly of claim 3, further comprising:

a first pull-in assembly on the vessel at the bow; and a second pull-in assembly on the vessel at the stern, wherein the first and second pull-in assemblies are arranged and designed to retrieve the forward and aft chain table assemblies, respectively, released from the vessel for reconnection to the first and second connector assemblies, respectively.

24. The disconnectable spread mooring assembly of claim 3, further comprising:

a forward chain table support structure housing the first connector assembly at the bow of the vessel; and an aft chain table support structure housing the second connector assembly at the stern of the vessel.

* * * * *